US010147533B2

(12) United States Patent
Lyoo et al.

(10) Patent No.: US 10,147,533 B2
(45) Date of Patent: Dec. 4, 2018

(54) INDUCTOR

(71) Applicant: SAMSUNG ELECTRO-MECHANICS CO., LTD., Suwon-si, Gyeonggi-do (KR)

(72) Inventors: Soo Hyun Lyoo, Suwon-si (KR); Se Woong Paeng, Suwon-si (KR); Jung Min Kim, Suwon-si (KR); Jeong Gu Yeo, Suwon-si (KR); Tae Hoon Kim, Suwon-si (KR); Sang Jun Lee, Suwon-si (KR); Ji Hyung Jung, Suwon-si (KR); Ji Man Ryu, Suwon-si (KR); Do Young Jung, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/093,275

(22) Filed: Apr. 7, 2016

(65) Prior Publication Data

US 2016/0351321 A1 Dec. 1, 2016

(30) Foreign Application Priority Data

May 27, 2015 (KR) ..... 10-2015-0074101
Oct. 16, 2015 (KR) ..... 10-2015-0144572

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/292* (2013.01); *H01F 41/041* (2013.01); *H01F 2027/2809* (2013.01)

(58) Field of Classification Search
CPC .... H01F 27/2804; H01F 27/292; H01F 27/28; H01F 2027/2809; H01F 41/041;
(Continued)

(56) References Cited

U.S. PATENT DOCUMENTS 8,009,006 B2 * 8/2011 Ahn ..... H01F 17/0013 29/602.1
9,601,259 B2 * 3/2017 Ozawa ..... H01F 17/0013
(Continued)

FOREIGN PATENT DOCUMENTS

CN 101341557 A 1/2009
CN 102360718 A 2/2012
(Continued)

OTHER PUBLICATIONS

Korean Office Action dated Oct. 18, 2016 issued in Korean patent application No. 10-2015-0144572. (w/ English translation).
(Continued)

*Primary Examiner* — Mangtin Lian
(74) *Attorney, Agent, or Firm* — McDermott Will & Emery LLP

(57) ABSTRACT

An inductor includes a body including an organic material and a coil part disposed in the body. External electrodes are disposed on outer surfaces of the body and connected to the coil part. The coil part includes a conductive pattern and a conductive via. An adhesive layer is disposed between the conductive pattern and the conductive via, and the adhesive layer is formed of a material different from materials of the conductive pattern and the conductive via.

20 Claims, 25 Drawing Sheets

(51) Int. Cl.
*H01F 27/29* (2006.01)
*H01F 41/04* (2006.01)

(58) Field of Classification Search
CPC .. H01F 5/003; H01F 17/0006; H01F 17/0013; H01F 2017/002
USPC ..... 336/200, 223, 232
See application file for complete search history.

(56) References Cited

U.S. PATENT DOCUMENTS

| | | | | |
|---|---|---|---|---|
| 2002/0050586 | A1 | 5/2002 | Oshita et al. | |
| 2009/0139754 | A1 | 6/2009 | Ikarashi et al. | |
| 2011/0037557 | A1 | 2/2011 | Konoue et al. | |
| 2011/0285494 | A1 | 11/2011 | Jeong et al. | |
| 2012/0274432 | A1 | 11/2012 | Jeong et al. | |
| 2013/0062106 | A1 | 3/2013 | Kim et al. | |
| 2013/0068513 | A1 | 3/2013 | Hirai et al. | |
| 2013/0147591 | A1 | 6/2013 | Kim et al. | |
| 2014/0097927 | A1* | 4/2014 | Yamamoto | H01F 1/344 336/200 |
| 2014/0132385 | A1 | 5/2014 | Maruyama et al. | |
| 2014/0167902 | A1 | 6/2014 | Yoon et al. | |
| 2015/0340151 | A1* | 11/2015 | Yosui | H01F 27/2804 336/200 |
| 2015/0371763 | A1* | 12/2015 | Gordin | H01F 17/0013 336/225 |

FOREIGN PATENT DOCUMENTS

| | | | | |
|---|---|---|---|---|
| CN | 102760553 | A | | 10/2012 |
| JP | H05-205961 | A | | 8/1993 |
| JP | H08-148828 | A | | 6/1996 |
| JP | H11-214575 | A | | 8/1999 |
| JP | H11-251751 | A | | 9/1999 |
| JP | 2000-049460 | A | | 2/2000 |
| JP | 2002-052644 | A | * | 2/2002 |
| JP | 2003-007559 | A | | 1/2003 |
| JP | 2005-119264 | A | | 5/2005 |
| JP | 2009-152347 | A | * | 7/2009 |
| JP | 2009-182188 | A | | 8/2009 |
| JP | 2009-277972 | A | | 11/2009 |
| JP | 2012-079870 | A | | 4/2012 |
| JP | 2012-151229 | A | | 8/2012 |
| JP | 2012-182379 | A | | 9/2012 |
| JP | 2013-512581 | A | | 4/2013 |
| JP | 2014-120759 | A | | 6/2014 |
| JP | 2014-130969 | A | | 7/2014 |
| KR | 10-2002-0020234 | A | | 3/2002 |
| KR | 10-2010-0101012 | A | | 9/2010 |
| KR | 10-2013-0064352 | A | | 6/2013 |

OTHER PUBLICATIONS

First Office Action issued in Chinese Patent Application No. 201610298452.1, dated Aug. 2, 2017 (with English translation).
Notice of Office Action in corresponding Japanese Patent Application No. 2016-096371, dated Aug. 1, 2017.
Japanese Office Action dated Jun. 5, 2018 issued in Japanese Patent Application No. 2016-096371 (with English translation).

* cited by examiner

INDUCTOR

CROSS-REFERENCE TO RELATED APPLICATION

This application claims the priority and benefit of Korean Patent Applications No. 10-2015-0074101 filed on May 27, 2015 and No. 10-2015-0144572 filed on Oct. 16, 2015, with the Korean Intellectual Property Office, the disclosures of which are incorporated herein by reference.

BACKGROUND

The present disclosure relates to a surface-mount device (SMD) inductor, and more particularly, to an inductor used in a high frequency band of 100 MHz or more.

A surface-mount device (SMD) inductor component is generally mounted on a circuit board. Such a product, used at a high frequency of 100 MHz or more, is referred to as a high-frequency inductor.

A high-frequency inductor is mainly used in an LC circuit for impedance matching. For example, multi-band devices that are configured for wireless communications at various frequencies may include such impedance matching circuits and, with the growth of the market for multi-band devices, the number of matching circuits in use is significantly increased. As a result, demand for high-frequency inductors has also increased.

An important technical trend in high-frequency inductors is the implementation of high-Q factor devices. Here, Q may be evaluated as wL/R (Q=wL/R). That is, a Q value is a function of a ratio of inductance (L) and resistance (R) in a given frequency band. Due to the trend for miniaturization of electronic components, efforts are being made to increase the Q value of inductors while decreasing sizes of the elements.

As noted above, high-frequency inductors are used in impedance matching circuits, and such high-frequency inductors may be manufactured so as to be suitable for a specific nominal inductance (L). Furthermore, in order to implement high-Q factor components, the components are generally required to be manufactured to have a higher Q value at a constant nominal inductance L.

However, referring to the Equation Q=wL/R, in order to increase Q while maintaining a same inductance, resistance (R) should be decreased in a use frequency band. As such, in a high frequency region of about 100 MHz to about 5 GHz, in which the high-frequency inductor is mainly used, there is a need to decrease resistance.

In order to decrease resistance, the thickness or the line width of a circuit coil pattern can be increased. In a case in which the line width is increased, an area of an internal core through which magnetic flux flows may be decreased and, as a side effect, inductance L may be decreased.

Therefore, it may instead be preferable to decrease resistance by decreasing an interlayer distance between coils while increasing the thickness of the coil pattern.

However, it is technically difficult to increase the thickness of the coil pattern, and since there is a height difference between a portion on which a coil is present and a portion on which the coil is not present in each of the layers to be stacked due to a thickness of the coil, a special method for decreasing the height difference may be required.

According to the related art, a high-frequency inductor is commonly manufactured using multilayer ceramic technology. That is, inductors have been manufactured by preparing a slurry using ferrite or a dielectric powder, a glass ceramic material, to manufacture a sheet; forming a circuit coil pattern using a conductive material formed of a silver (Ag) ingredient and a screen printing method to manufacture each of the layers; simultaneously stacking the manufactured layers; sintering the stacked layers; and then, forming external terminal electrodes thereon.

In a ceramic inductor according to the related art, a circuit coil pattern has been formed by a screen printing method.

As a result, a limit is reached on increasing a thickness of the circuit coil pattern at the time of printing the circuit coil pattern, and the thickness of the wire may decrease during sintering, such that it is difficult to increase the thickness of circuit coil patterns.

In addition, even in a case of increasing the thickness of the circuit coil pattern, at the time of simultaneously stacking each of the layers, a step portion may be generated. However, in the related art using ceramic sheets, a separate process and materials, such as printing of a non-circuit part, a step portion absorption sheet, and the like, are required in order to solve the step portion problem as described above, and this separate process may deteriorate manufacturing yield and productivity.

SUMMARY

The present disclosure relates to an inductor, and more particularly, to a high-frequency inductor.

As described above, in multilayer ceramic technology according to the related art, it is difficult to increase a thickness of a circuit coil pattern and decrease a step portion.

An aspect of the present disclosure provides an inductor, particularly, a high-frequency inductor capable of solving technical problems such as an increase in thickness of a circuit coil pattern, a decrease in step portions, and the like. The disclosure further provides a method of using an organic insulator, unlike commonly-used multilayer ceramic technology.

According to an aspect of the present disclosure, an inductor may include a body including an organic material and a coil part disposed within the body, wherein the coil part includes a conductive pattern and a conductive via, and the conductive via contains tin (Sn) or a tin (Sn)-based intermetallic compound (IMC) as a metal ingredient.

The IMC may be formed in the conductive via or at an interface between the coil part and the via and may be $Cu_3Sn$, $Cu_6Sn_5$, $Ag_3Sn$, and the like.

According to a further aspect of the disclosure, an inductor includes a body having an organic material and a coil part disposed within the body, and external electrodes disposed on outer surfaces of the body and connected to the coil part. The coil part includes a conductive pattern and a conductive via, an adhesive layer is disposed between the conductive pattern and the conductive via, and the adhesive layer is formed of a material different from materials of the conductive pattern and the conductive via.

Further, another aspect of the disclosure provides an inductor including a body containing a photosensitive organic material, a coil part disposed within the body, and two external electrodes disposed on outer surfaces of the body and electrically connected to respective ends of the coil part.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
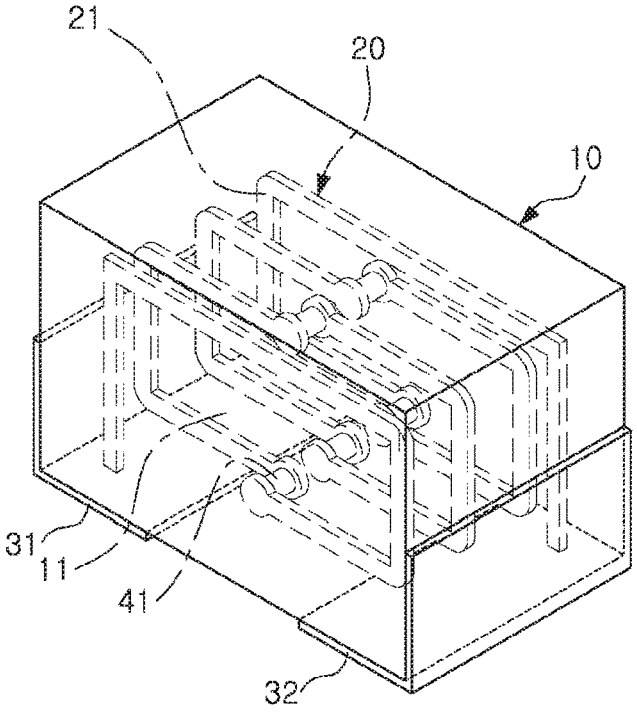
FIG. 1 is a perspective view illustrating an interior of an inductor according to an exemplary embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," and "lower" and the like, may be used herein for ease of description to describe one element's positional relationship to another element (s) as shown in the orientation shown in the figures. It will be understood that the spatially relative positional terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures and/or devices. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present disclosure will be described with reference to schematic views illustrating embodiments of the present disclosure. In the drawings, for example due to manufacturing techniques and/or tolerances, modifications of the shapes shown may be estimated. Thus, embodiments of the present disclosure should not be construed as being limited to the particular shapes of regions shown herein, but should more generally be interpreted as including, for example, a change in shape resulting from manufacturing processes. The following embodiments may also be constituted by one or a combination thereof.

The contents of the present disclosure described below may have a variety of configurations, and only illustrative configurations are shown and described herein. The inventive concepts should not be interpreted as being limited to those illustrative configurations.

FIG. 1 is a perspective view illustrating an interior of an inductor according to an exemplary embodiment.

Figure 2:
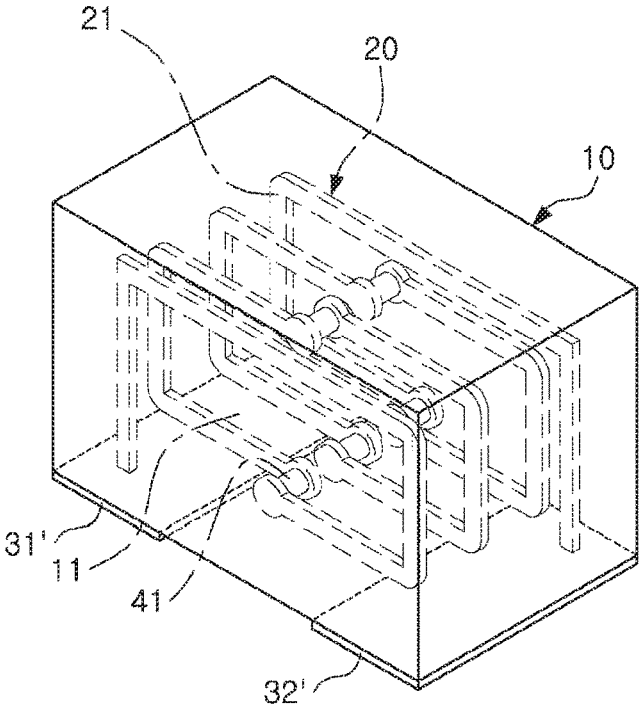
FIG. 2 is a perspective view illustrating an interior of an inductor according to another exemplary embodiment.

FIG. 2 is a perspective view illustrating an interior of an inductor according to another exemplary embodiment.

Figure 3:
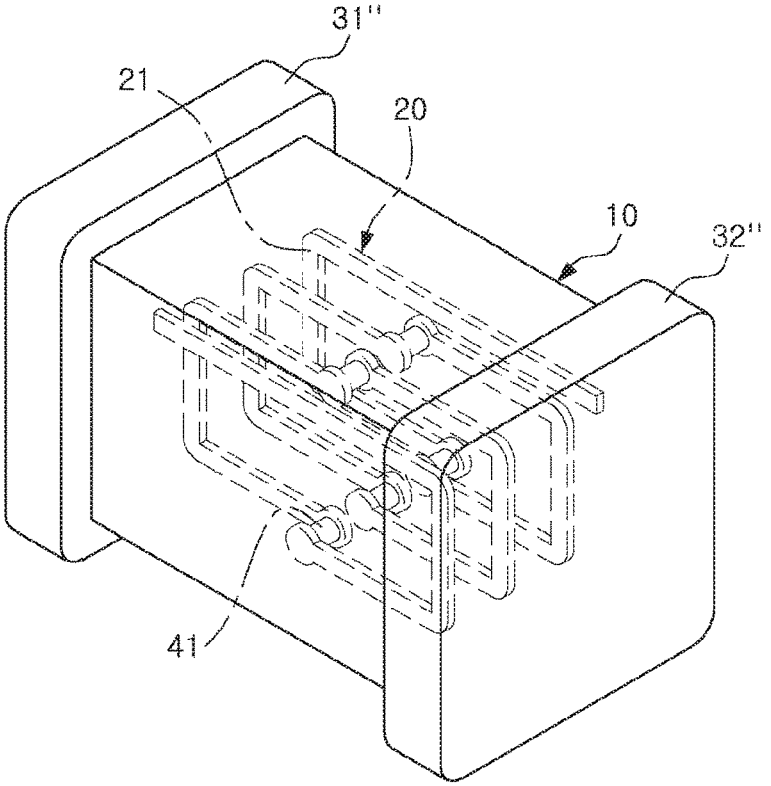
FIG. 3 is a perspective view illustrating an interior of an inductor according to another exemplary embodiment.

FIG. 3 is a perspective view illustrating an interior of an inductor according to another exemplary embodiment.

Referring to FIG. 1, an inductor according to the exemplary embodiment may include a body 10 including an organic material, and a coil part 20 and external electrodes 31 and 32 disposed on both ends of the body 10.

Further, the coil part 20 may include a conductive pattern 21 and one or more conductive via(s) 41.

The body 10 may contain an organic material containing an organic ingredient.

The organic material may be a thermally curable organic material having a B-stage or a photosensitive organic material simultaneously having an ultraviolet (UV) curing mechanism and a thermal curing mechanism. The body 10 may further contain an inorganic ingredient such as $SiO_2$/$Al_2O_3$/$BaSO_4$/Talc, or the like, as a filler ingredient.

In contrast, since a body of an inductor according to the related art is formed of a ceramic material such as glass ceramic, $Al_2O_3$, ferrite, or the like, and sintered at 800° C. or more, substantially, the body does not contain an organic ingredient.

Meanwhile, the conductive pattern 21 is formed of a copper (Cu) wiring. As a method of forming a wire circuit, there are provided a tenting method using Copper (Cu) foil etching, a semi-additive process (SAP) method using copper plating, a modified semi-additive process (MSAP), and the like, and in accordance with the present disclosure, any such method may be used.

The conductive via(s) 41 may be formed of a paste in which an organic material and a metal are mixed with each other, or formed of a metal by a plating method, and may contain Sn or an Sn-based intermetallic compound (IMC) as a metal ingredient.

According to the exemplary embodiment in the present disclosure, an adhesive layer may be formed between the conductive pattern 21 and the conductive via 41, and a material forming the adhesive layer may be different from those of the conductive pattern 21 and the conductive via 41.

The adhesive layer may be formed of a material having a melting point lower than those of the conductive pattern 21 and the conductive via 41.

The conductive pattern 21 and the conductive via 41 may contain copper (Cu), and the adhesive layer may contain tin (Sn). For example, a Sn-based intermetallic compound (IMC) may be formed at an interface between the conductive pattern 21 and the conductive via 41. Examples of the Sn-based IMC may include $Cu_3Sn$, $Cu_6Sn_5$, $Ag_3Sn$, and the like.

The Sn-based intermetallic compound is formed at the interface between the conductive pattern 21 and the conductive via 41, but may or may not be formed in the conductive via 41.

In the related art, a conductive pattern in an inductor using a ceramic technology may be formed as a sintered body formed of silver/copper (Ag/Cu), and a conductive via may also be formed as a sintered body formed of silver/copper (Ag/Cu), similarly to the conductive pattern.

In the related art, ingredients of the conductive via and conductive pattern may be slightly changed due to a sintering additive, or the like, but a main ingredient (80 wt % or more) is a metal sintered body. Since an organic material may be burned to thereby be removed while the metal sintered body is formed by sintering, the conductive via and the conductive pattern do not substantially contain the organic material.

In contrast, the conductive via 41 according to the exemplary embodiment is not a metal electrode but may be formed of a metal paste containing the organic material or may be a metal pillar formed using a plating method.

The conductive via 41 may contain Sn or the Sn-based intermetallic compound (IMC) as the metal ingredient.

According to the exemplary embodiment, the conductive pattern 21 may be formed as a copper (Cu) wiring pattern manufactured by a plating method, a rolling method, or the like, but the conductive via 41 may be formed of the paste in which the organic material and the metal were mixed with each other or formed by a plating method.

The paste may contain the organic material in a volume ratio of about 20 to 80%.

Further, the conductive via 41 formed by the plating method may be a substantially pure metal. More specifically, in both a case in which the via is formed of an organic-metal composite material and a case in which the via is formed by the plating method, the metal may include tin (Sn) or a tin (Sn)-based mixed metal.

According to the exemplary embodiment, the conductive pattern 21 and the conductive via 41 may come into direct contact with each other by simultaneous stacking, and an intermetallic compound layer may be formed at the interface therebetween.

In order to easily form the intermetallic compound layer, heat treatment may be performed separately from (and subsequent to) the simultaneous stacking.

In a general build-up type printed circuit board technology such as that used in the related art, since a conductive via is formed of the same metal material as that of a conductive pattern, an IMC layer is not formed.

In contrast, in the exemplary embodiment described herein, the conductive pattern 21 and the conductive via 41 may be connected to each other using a novel method, unlike a general build-up method. In detail, conductive pattern 21 and the conductive via 41 may be electrically connected to each other by diffusion bonding between a metal forming the conductive pattern 21 and a metal forming the conductive via 41.

According to the exemplary embodiment, the conductive via 41 may contain tin (Sn) for forming an electrical connection between the conductive pattern 21 and the conductive via 41.

The conductive via 41 may contain tin (Sn), such that the intermetallic compound may be easily formed through a reaction with copper (Cu) which is used as a main ingredient of the conductive pattern 21.

A contact between the conductive via 41 and the conductive pattern 21 may be changed to a contact by a chemical bond rather than a simple physical contact by allowing the intermetallic compound to be formed therebetween.

The entire conductive via 41 may contain tin. Alternatively, the conductive via 41 may only contain tin in a region located in the vicinity of the interface at which the conductive via 41 and the conductive pattern 21 come into contact with each other during the simultaneous stacking.

In a case of only disposing tin in the portion of the conductive via 41 that is in the vicinity of the interface at which the conductive via 41 and the conductive pattern 21 come in contact with each other during the simultaneous stacking, a tin (Sn) layer may only be disposed in the vicinity of the interface using tin (Sn) plating.

A compound containing tin (Sn) and copper (Cu) may be formed between the conductive pattern 21 and the adhesive layer, and a compound containing tin (Sn) and copper (Cu) may be formed between the conductive via 41 and the adhesive layer.

According to the exemplary embodiment, unlike a printed circuit board (PCB) or an inductor embedded in the PCB, the external electrodes 31 and 32 may be disposed at both ends of the body 10.

The external electrodes 31 and 32 may be formed as a pair and disposed in positions opposite each other in a length direction of the body 10. In more detail, outermost layers of the external electrodes 31 and 32 may be tin (Sn) plating layers, and nickel (Ni) plating layers may be disposed below the tin (Sn) plating layers.

Referring to FIG. 1, in the inductor according to the exemplary embodiment, the external electrodes 31 and 32 may each have an 'L' shape extending around a corner of the body 10.

That is, the external electrodes 31 and 32 may be formed on the body 10 to be symmetrical to each other in the length direction of the body 10, and to each extend from a respective end surface of the body 10 to a lower surface of the body 10.

In a case in which the external electrodes 31 and 32 have the 'L' shape as described above (and shown in FIG. 1), generation of parasitic capacitance may be significantly decreased as compared to a case in which external electrodes are disposed on both end surfaces of the body in the length direction and upper and lower surfaces thereof, as is common in the inductor according to the related art. The reduced parasitic capacitance of the external electrodes 31 and 32 enable a higher Q factor to be provided.

Further, at the time of mounting the inductor on a board, a solder application area may be increased as compared to a shape of external electrodes of FIG. 2 to be described below, such that at the time of mounting the inductor on the board, adhesive strength of the inductor may be improved.

Referring to FIG. 2, in the inductor according to another exemplary embodiment in the present disclosure, external electrodes 31' and 32' may be disposed on a lower surface of a body 10 (e.g., the external electrodes 31' and 32' may be disposed only on the lower surface of a body 10).

In a case in which the external electrodes 31' and 32' are disposed on the lower surface of the body 10 as described above, the generation of parasitic capacitance may be significantly decreased as compared to the case in which external electrodes are disposed on both end surfaces of the body in the length direction as well as on upper and lower surfaces thereof (e.g., as is common in inductors according to the related art). The parasitic capacitance may also be decreased as compared to a case in which external electrodes have an 'L' shape, as in the external electrodes illustrated in FIG. 1. The decrease in parasitic capacitance enables a higher Q factor to be provided.

Referring to FIG. 3, in the inductor according to other exemplary embodiment, external electrodes 31" and 32" are disposed on regions including both end surfaces of the body 10 in the length direction and including upper and lower surfaces of the body 10.

Meanwhile, referring to FIGS. 1 through 3, the coil part 20 may be disposed to be perpendicular to a mounting surface of the inductor. For example, each winding of coil part 20 may be substantially planar and disposed to extend perpendicular to the lower surface of the body 10, where the lower surface of the body 10 serves at the mounting surface.

According to the exemplary embodiment, the body 10 may be formed by stacking a plurality of layers containing an organic material.

The body 10 is unlike a thin film type power inductor that is com of two or less layers, includes a separate core layer, and has stacked on the core layer or a thin film type common mode filter (CMF) in which a core layer and a build-up layer are formed of different dielectric materials from each other. Specifically, the body 10 of the inductor according to the exemplary embodiment may only be composed of the plurality of layers containing the organic material, and the body does not have a portion corresponding to the core layer.

More specifically, a thickness of a single layer among the plurality of layers may be 50 μm or less.

Further, the plurality of layers containing the organic material may come in contact with each other.

According to the exemplary embodiment, the body 10 may further contain an inorganic material, and a content of the inorganic material may be smaller than that of the organic material.

In contrast to the exemplary embodiment, bodies of inductors of the prior art are generally formed of a ceramic material such as glass ceramic, $Al_2O_3$, ferrite, or the like, and the bodies do not substantially contain an organic ingredient.

A cross-sectional shape of the conductive via 41 may be tetragonal, but is not necessarily limited thereto.

In an inductor manufactured by sequential stacking using a general build-up method, a cross-sectional shape of a via is trapezoidal, but in the inductor according to the exemplary embodiment described herein, the cross-sectional shape of the via may be tetragonal.

According to the exemplary embodiment, a tin (Sn) layer may be further disposed between the conductive pattern 21 and the conductive via 41.

The tin (Sn) layer may be formed by plating, but is not necessarily limited thereto.

The tin (Sn) layer may be disposed between the conductive pattern 21 and the conductive via 41 for adhesion between the conductive pattern 21 and the conductive via 41.

Figure 4:
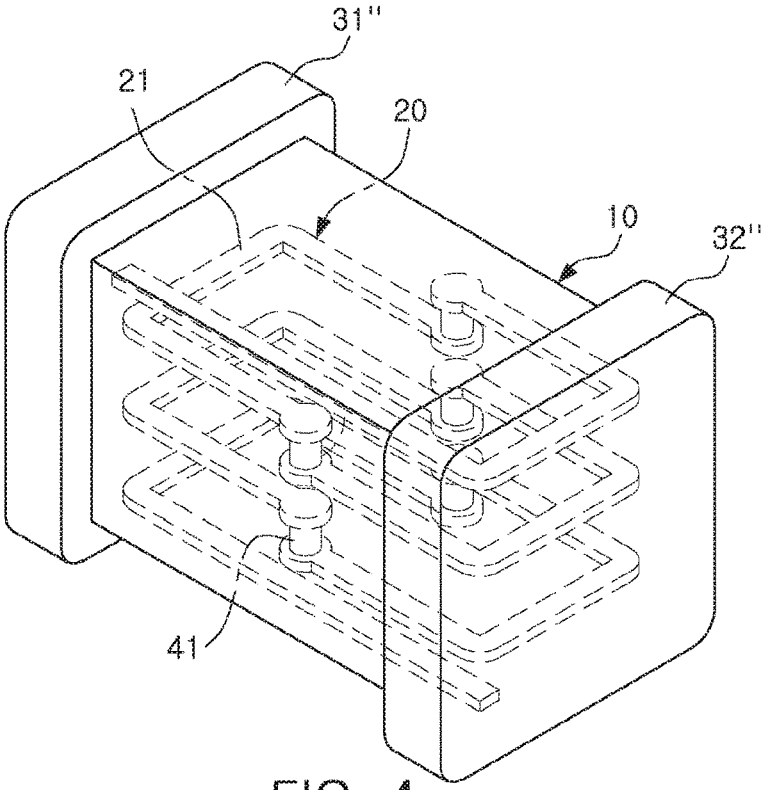
FIG. 4 is a perspective view illustrating an interior of an inductor according to another exemplary embodiment.

FIG. 4 is a perspective view illustrating an interior of an inductor according to another exemplary embodiment.

Referring to FIG. 4, in the inductor according to the other exemplary embodiment, a coil part 20 including a conductive pattern 21 and a conductive via 41 may be disposed parallel to a board mounting surface of the inductor, and other features thereof may be the same as those of the inductor according to the exemplary embodiment described above.

Hereinafter, various processes for manufacturing the inductor according to the exemplary embodiment will be described. These processes are illustrative, and a manufacturing method of the inductor is not limited thereto.

FIGS. 5A through 5G show sequential steps of a manufacturing process for an inductor according to Inventive Example 1.

FIGS. 6A through 6K show sequential steps of a manufacturing process for an inductor according to Inventive Example 2.

FIGS. 7A through 7L show sequential steps of a manufacturing process for an inductor according to Inventive Example 3.

FIGS. 8A through 8M show sequential steps of a manufacturing process for an inductor according to Inventive Example 4.

FIGS. 9A through 9M show sequential steps of a manufacturing process for an inductor according to Inventive Example 5.

FIGS. 10A through 10M show sequential steps of a manufacturing process for an inductor according to Inventive Example 6.

Inventive Example 1

1. Lamination of Dielectric Film in Semi-Cured State with Carrier Film (S1)

Figure 5A:
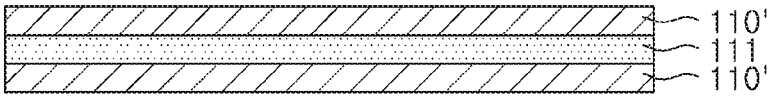
FIGS. 5A through 5G show sequential steps of a manufacturing process for an inductor according to Inventive Example 1.

A carrier film 110', a resin film used for handling and protecting a dielectric film 111 in each of the process operations, may be adhered to both surfaces of the dielectric film 111, as shown in FIG. 5A.

The carrier film 110' may be formed of a resin material such as polyethylene terephthalate (PET), polyethylene-naphthalate (PEN), polycarbonate (PC), or the like, and have a thickness of 10 to 200 μm.

In the present Inventive Example, a PET film having a thickness of 50 μm may be used.

The carrier film 110' may have adhesive force, but may also be easily detached.

To this end, adhesion and detachment may be adjusted using a high-temperature foamable adhesive, a UV curable adhesive, or the like.

In the present Inventive Example, the carrier film 110' and the dielectric film 111 may be adhered to each other using a high-temperature foamable adhesive having an adhesive force that is lost when heated to 100° C.

The dielectric film 111 may be formed of a thermosetting resin material having a semi-cured state.

In the present Inventive Example, a bismaleimide-triazine (BT) resin may be used. The dielectric film 111 may be in a semi-cured state during the lamination. In order to implement the semi-cured state, a thermosetting resin material or a material having both a UV curing mechanism and a thermal curing mechanism may be used.

In the present Inventive Example, a thickness of the dielectric film 111 may be 10 μm.

2. Formation of Via Hole Using Laser Drilling (S2)

Figure 5B:
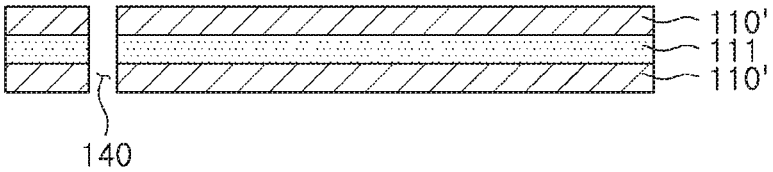

A via hole 140 may be formed by a laser drilling method in the dielectric film 111 while the dielectric film 111 is laminated with the carrier film 110', as shown in FIG. 5B.

In the laser drilling method, any of a $CO_2$ laser and solid laser may be used, and a diameter of the hole 140 may be in a range of 10 to 200 μm.

In the present Inventive Example, the via hole 140 having a diameter of 40 μm may be formed using a solid UV laser.

3. Filling of Metal Paste in Via Hole (S3)

Figure 5C:
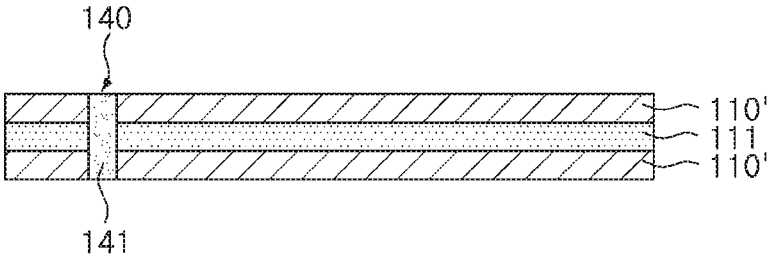

A via conductor 141 may be formed by filling a metal paste in the via hole 140 using a paste printing method, as shown in FIG. 5C. The metal paste may be a dispersion or mixture of a conductive metal (e.g., in powder form) and an organic binder. In the present Inventive Example, a metal paste containing the conductive metal in a volume ratio of 20 to 80 vol % may be used.

In a case in which a ratio of the metal is low, electrical conductivity may be deteriorated, which may have a negative influence on resistance and the Q factor of the inductor. On the contrary, in a case in which the ratio of the metal is excessively high, it may be difficult to disperse the metal and print the metal paste.

4. Removal of Carrier Film and Lamination of Copper Foil (S4)

Figure 5D:
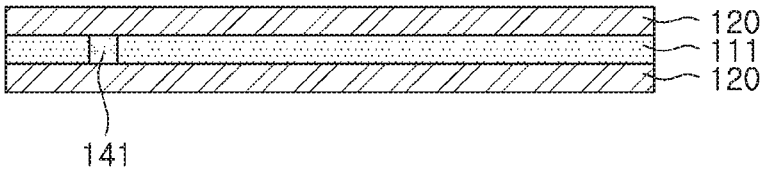
Figure 5E:
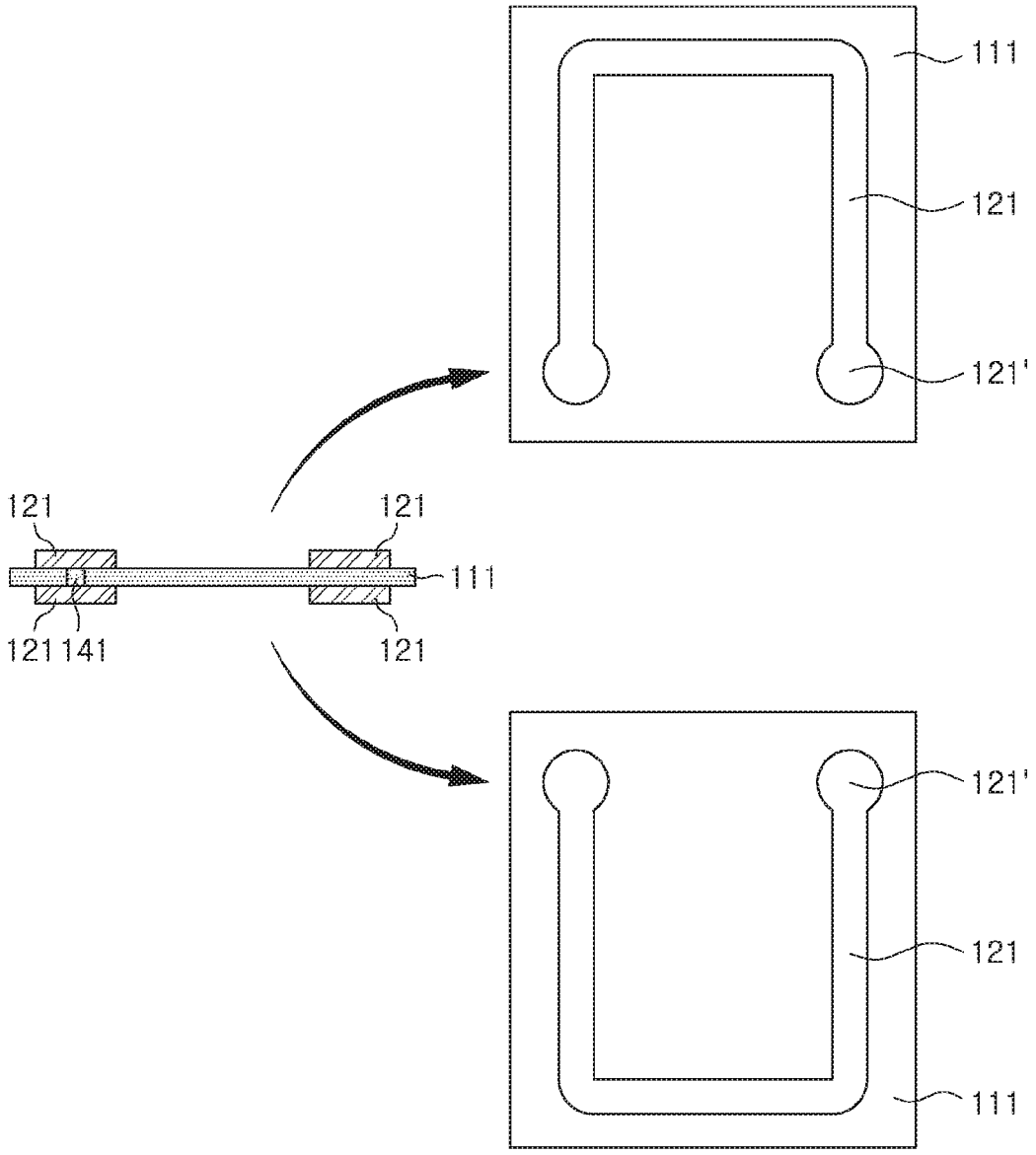

The carrier film 110' may be removed, and copper foil 120 may be laminated on both surfaces of the dielectric film 111, as shown in FIG. 5D. After removing adhesive force of the foamable tape by heating at 100° C. for 30 seconds, the carrier film 110' may be removed. After the carrier film 110' is removed, the copper foil 120 may be attached to the dielectric film. In this case, a thickness of the copper foil 120 may be variously adjusted in a range of 3 to 50 μm. In the present Inventive Example, copper foil 120 having a thickness of 8 μm may be used.

5. Formation of Circuit Pattern Using Pattern Etching Method (S5)

Exposure, development, and etching may be performed using a dry film resist. A negative dry film may be attached to both surfaces of the dielectric film on which the copper foil is attached, and then subjected to exposure and development. Finally, the copper foil may be etched through a portion from which the dry film has been removed. In this case, a circuit pattern 121 shown in FIG. 5E may be formed to have a width of 15 μm. At the time of forming the circuit pattern 121, a via pad 121' formed in a location corresponding to a location in which the circuit pattern 121 and a via conductor 141 are connected to each other may be formed together with the circuit pattern 121. A size (e.g., diameter) of the via pad 121' may be 50 μm.

6. Stacking of Each of the Individually Formed Layers (S6)

Even layers 111*c* and 111*e* in which only a via is formed may be manufactured separately from odd layers 111*b*, 111*d*, and 111*f* on which the circuit pattern 121 is formed as described above. The even layers may be easily manufactured by only removing the carrier film in step S4.

Figure 5F:
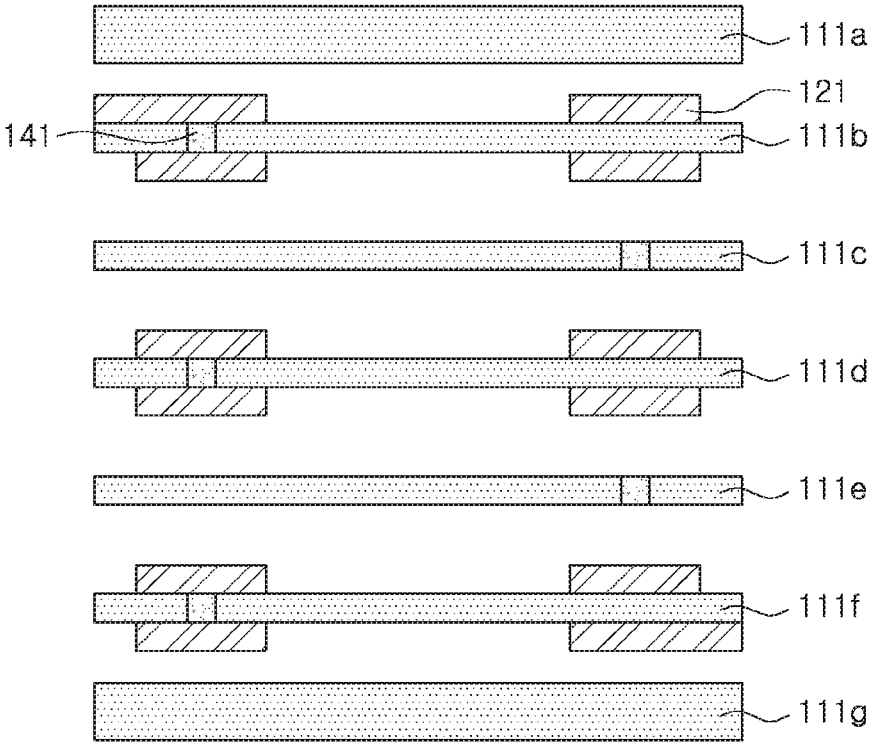

At the time of stacking each of the layers as shown in FIG. 5F, outermost layers 111*a* and 111*g* are included for blocking a conductor from the outside. The outermost layers 111*a* and 111*g* may be formed of an insulator. In the present Inventive Example, a cover film (e.g., 111*a* and 111*g*) may be manufactured using a film formed of the same material as that of an inner layer dielectric film. A thickness of a cover layer film may be 30 μm.

Figure 5G:
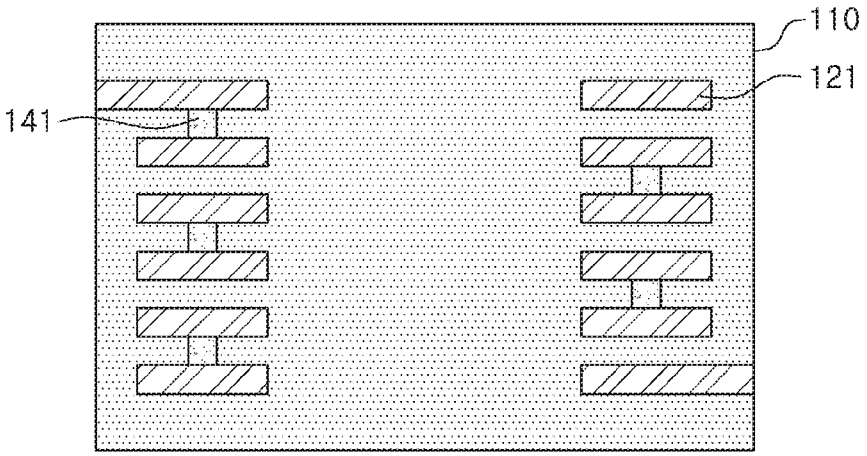

A body 110 in which the circuit pattern(s) 121 and the via conductor(s) 141 are formed as illustrated in FIG. 5G may be manufactured by simultaneously stacking each of the layers individually formed as described above and compressing the simultaneously stacked layers.

Further process steps may be performed for forming the inductor, and these further process steps may be similar to process steps for forming a general inductor. In detail, cutting, polishing, forming external electrodes, and nickel/tin plating on outer edges of the external electrodes may be performed, and finally, measuring and taping may be additionally performed.

Inventive Example 2

1. Lamination of Copper Foil on Dielectric Film (S1)

Figure 6A:
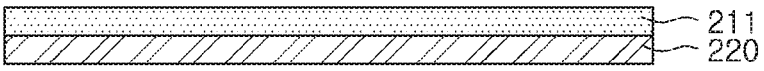
FIGS. 6A through 6K show sequential steps of a manufacturing process for an inductor according to Inventive Example 2.

Copper foil 220 may be laminated on a dielectric film 211, as shown in FIG. 6A. The copper foil 220 and the dielectric film 211 may be the same as those in Inventive Example 1.

2. Lamination of Carrier Film (S2)

Figure 6B:
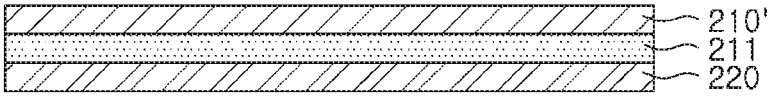

In the present Inventive Example, as a carrier film 210', a PET film having a thickness of 20 μm may be used. Similarly to Inventive Example 1, the carrier film 210' may be attached as shown in FIG. 6B using an adhesive having a mechanism capable of adjusting adhesive force.

3. Formation of Via Hole Using Laser Drilling (S3)

Figure 6C:
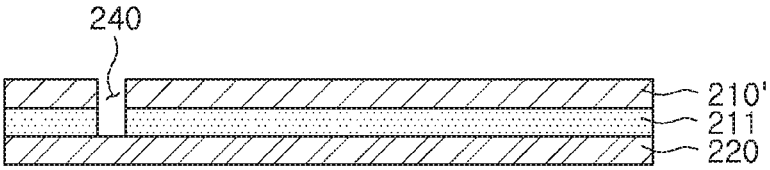

A via hole 240 may have the same diameter (40 μm) as that in Inventive Example 1. The via hole 240 may be formed similarly to via hole 140, and may be formed to extend through the dielectric film 211 and the carrier film 210' as shown in FIG. 6C. Note that the via hole 240 may not extend through the copper foil 220.

4. Formation of Seed Layer by Sputtering (S4)

Figure 6D:
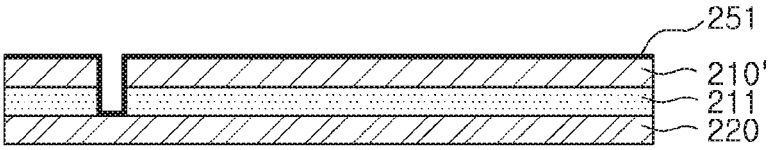

A titanium (Ti) thin film 251 may be formed using a sputtering method. The thin film 251 may be formed to have a thickness of 1 μm. As shown in FIG. 6D, the thin film 251 may be formed on one surface of the carrier film 210', and may be formed inside the via hole 240.

5. Removal of Carrier Film (S5)

Figure 6E:
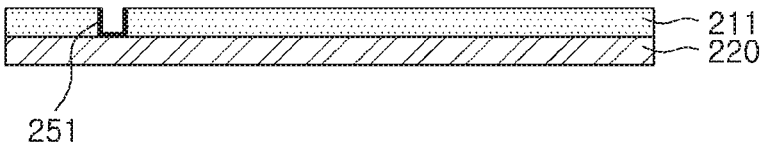

The carrier film 210' may be removed as shown in FIG. 6E using an adhesive adjusting mechanism similarly to Inventive Example 1.

6. Formation of Via Conductor Using Electroplating Method (S6)

Figure 6F:
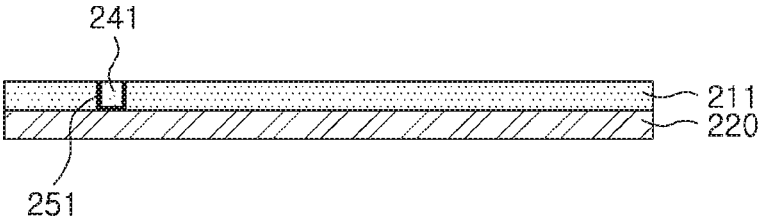

A via conductor 241 may be formed by plating the via hole 240 using copper (Cu) electroplating, as shown in FIG. 6F. The via conductor 241 may be plated inside the via hole 240 on surfaces of the thin film 251.

7. Tin (Sn) Plating Using Electroplating Method (S7)

Figure 6G:
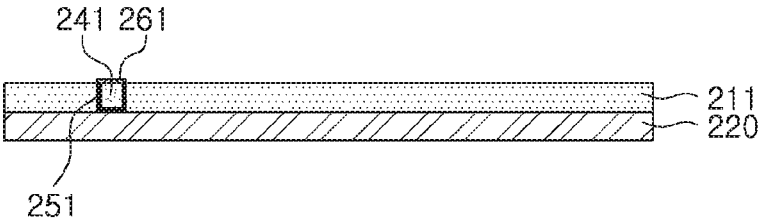

A tin plating layer 261 may be formed by performing tin (Sn) plating on the via conductor 241 in order to secure interlayer connection reliability, as shown in FIG. 6G.

The tin plating may be performed only at an interface that will come in contact with another layer at the time of simultaneously stacking the layers later.

8. Attachment of Protective Masking Film 270 (S8)

Figure 6H:
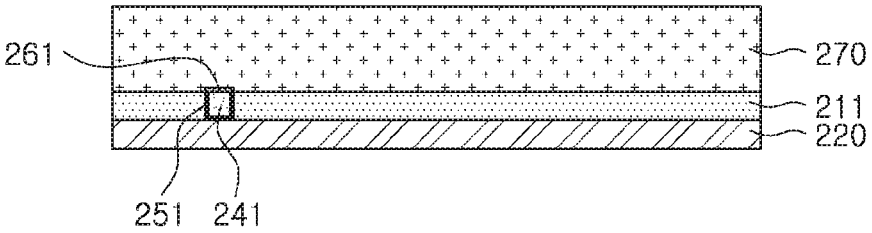

A protective masking film 270 may be formed on a surface of the dielectric film 211 to cover the dielectric film 211 and the tin plating layer 261, as shown in FIG. 6H.

9. Formation of Circuit Pattern 221 Through Attachment/Exposure/Development/Etching of Dry Film Resist (S9)

Figure 6I:
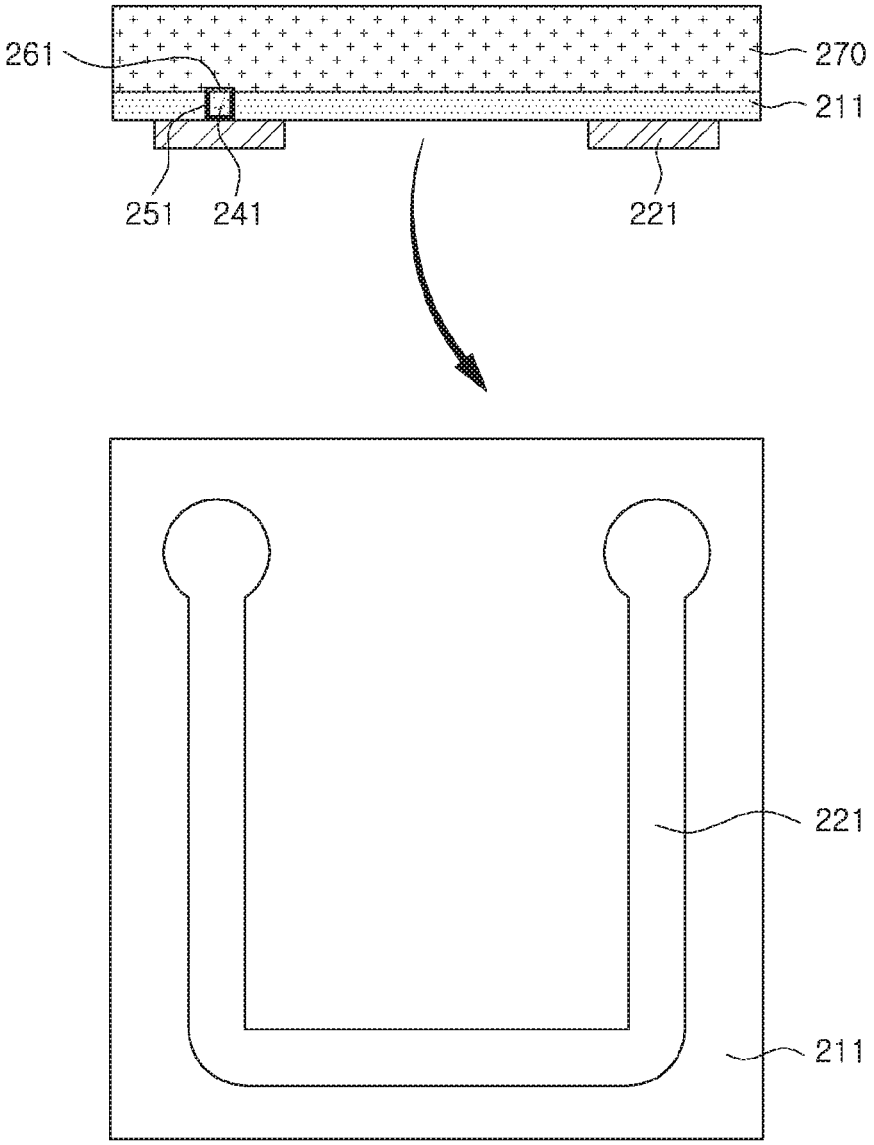

The circuit pattern 221 is formed as shown in FIG. 6I through attachment/exposure/development/etching of a dry film resist, similarly to circuit pattern 121.

10. Removal of Masking Film and Stacking of Each of the Layers (S10)

Figure 6J:
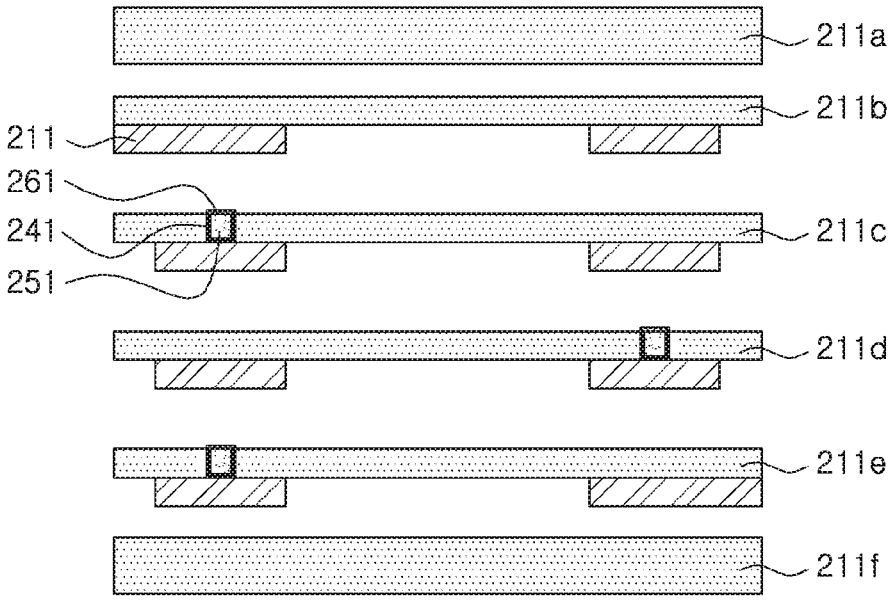

The masking film 270 may be removed following step S9, and each of the layers 211*a* to 211*f* may be stacked as shown in FIG. 6J. Since there is a need to form an Sn—Cu intermetallic compound for smooth connection of the via conductors 241, vacuum pressing may be performed at 230° C. for 1 hour. The intermetallic compound may be formed by heating, and at the same time, a resin in a semi-cured state may be completely cured.

For stable electrical connection of the plated tin layer, a circuit layer, and the copper via conductor 241, a heat treatment may be separately performed.

Heat treatment (maximum heat treatment temperature: 260° C.) may be performed for 1 second.

The intermetallic compound between tin and a circuit conductor may be sufficiently formed by an additional heat treatment as described above.

Figure 6K:
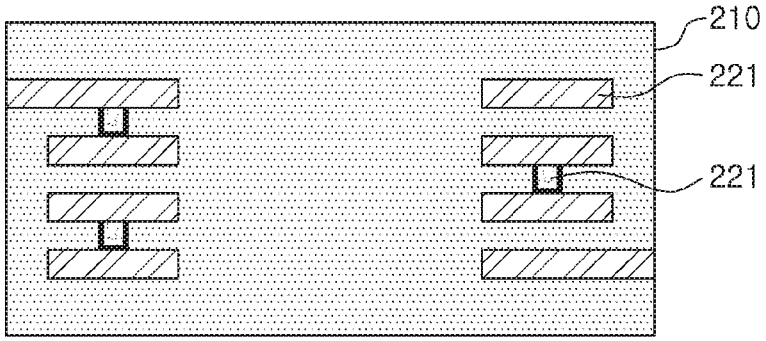

A body 210 in which the circuit pattern 221 and the via conductor 241 may be formed as illustrated in FIG. 6K may be manufactured by simultaneously stacking each of the layers 211*a* to 211*f*, individually formed as described above, and compressing the simultaneously stacked layers.

11. Subsequently, the forming of external terminal electrodes may be similar to that in a manufacturing process of a general inductor (S11).

Inventive Example 3

1. Adhesion of Carrier Film and Copper Foil (S1)

Figure 7A:
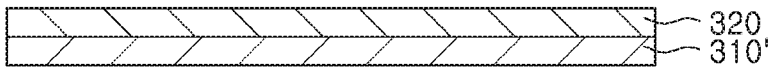
FIGS. 7A through 7L show sequential steps of a manufacturing process for an inductor according to Inventive Example 3.

A carrier film 310', which is a resin film used for handing and protecting a dielectric film 111 in each of the process operations, may be adhered to copper foil 320, as shown in FIG. 7A.

The carrier film 310' may be formed of a resin material such as polyethylene terephthalate (PET), polyethylene-naphthalate (PEN), polycarbonate (PC), or the like, and may have a thickness of 10 to 200 μm.

In the present Inventive Example, a PET carrier film having a thickness of 50 μm may be used.

The carrier film 310' may have adhesive force but may be easily detached at the time of removing the carrier film 310'.

To this end, adhesion and detachment may be adjusted using a high-temperature foamable adhesive, a UV curable adhesive, or the like.

In the present Inventive Example, the carrier film 310' and the copper foil 320 may be adhered to each other using a high-temperature foamable adhesive which loses adhesive force when heated to 100° C.

In the present Inventive Example, since a circuit is formed by a modified semi-additive process (MSAP) unlike Inventive Examples 1 and 2, a copper foil 320 having a thin thickness may be used.

In the present Inventive Example, copper foil 320 having a thickness of 2 μm may be used.

2. Lamination of DFR (PR) on Copper Foil (S2)

Figure 7B:
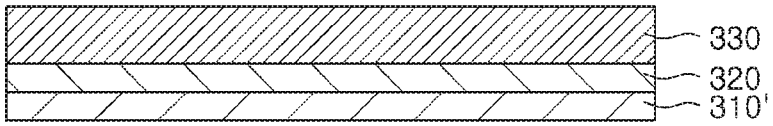

In order to form a circuit pattern, a dry film resist (DFR) 330 may be laminated on the copper foil 320 as shown in FIG. 7B. The dry film resist (DFR) 330 may be a subsidiary material for exposure/development.

3. Exposure/Development (S3)

Figure 7C:
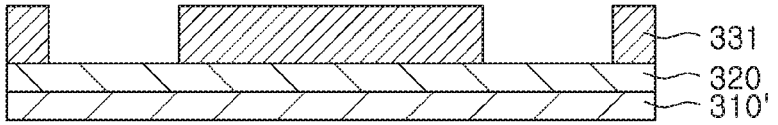

A dry film pattern 331 may be formed by exposure/development of the DFR 330, as shown in FIG. 7C.

4. Electroplating (S4)

Figure 7D:
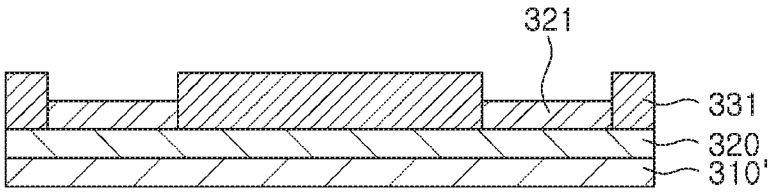

A circuit pattern 321 may be formed by electroplating (Cu plating), as shown in FIG. 7D. The circuit pattern 321 may thereby be deposited in gaps in the DFR 330 that are formed by the dry film pattern 331. A plating thickness may be 8 μm.

5. Delamination of Dry Film Resist (DFR) (S5)

Figure 7E:
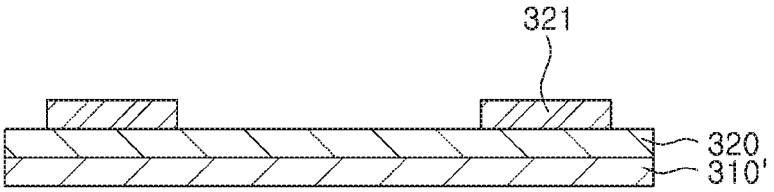

The circuit pattern 321 on each of the layers may be completed by removing the dry film resist (DFR) 330, as shown in FIG. 7E.

6. Formation of Paste Bump (S6)

Figure 7F:
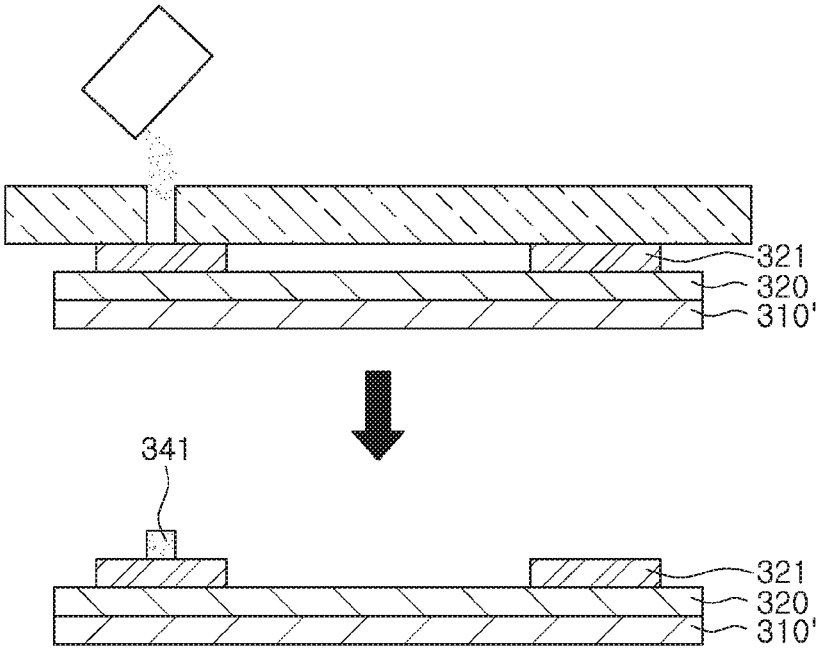

A metal paste bump for a via may be formed using a metal mask by a printing method, as shown in FIG. 7F. A diameter of a bump 341 may be 30 μm, and a height thereof immediately after printing may be 20 μm.

A metal material of the used paste may be a mixed metal composed of 50 wt % of a tin-bismuth (Sn—Bi) alloy and 50 wt % of copper (Cu), and an epoxy resin may be used as a binder. A viscosity of the paste may be 200 Pa·s (Pascal-second), and a solvent ingredient may be evaporated by drying the paste at 60° C. for 30 minutes after printing.

7. Lamination of Dielectric Layer (S7)

Figure 7G:
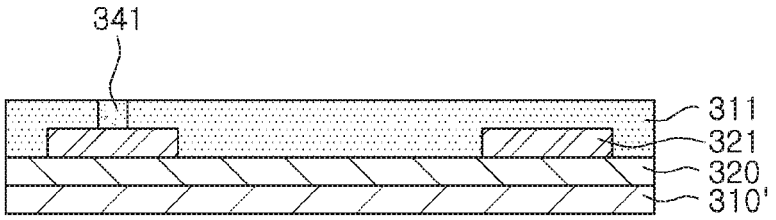

A dielectric film 311 may be laminated on the copper foil 320 on which the bump 341 is formed and the circuit pattern 321, as shown in FIG. 7G. A BT resin may be used as in Inventive Example 1, and the dielectric film 311 may be formed to have a thickness of 20 μm.

8. Attachment of Protective Masking Film (S8)

Figure 7H:
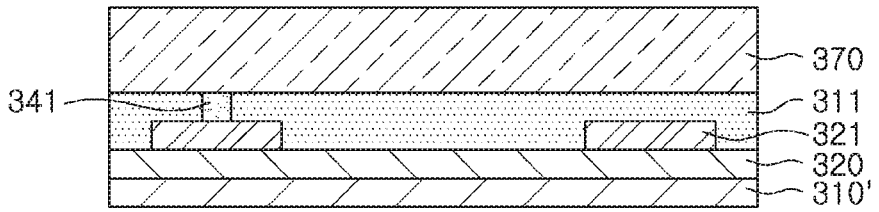

A protective masking film 370 may be attached, as shown in FIG. 7H.

9. Removal of Carrier Film (S9)

Figure 7I:
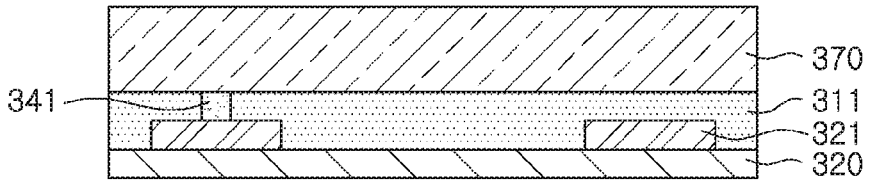

The carrier film 310' may be removed, as shown in FIG. 7I. The same film as that in Inventive Example 1 may be removed by the same method as in Inventive Example 1.

10. Etching of Copper Foil (S10)

Figure 7J:
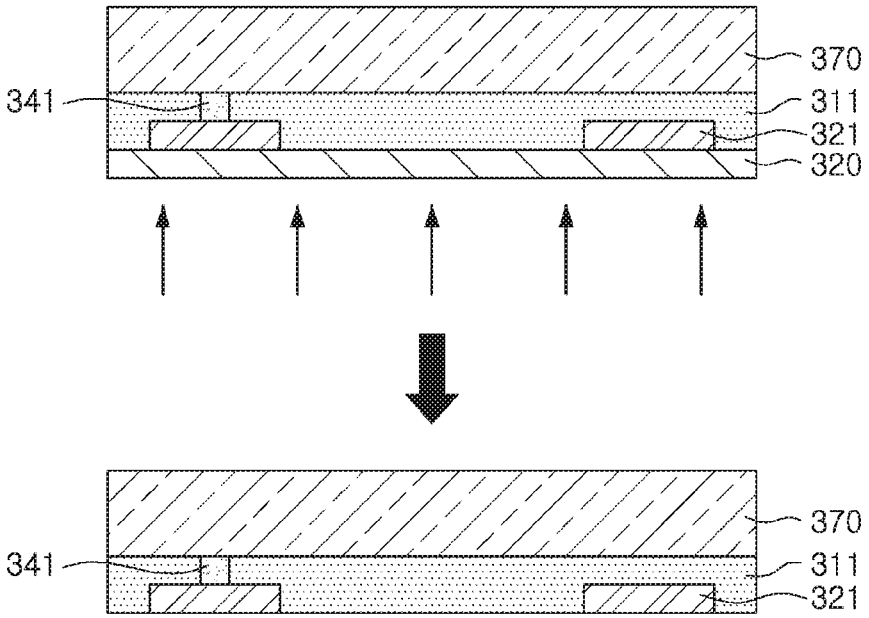

The copper foil 320 used as a seed layer for electroplating may be removed by etching, as shown in FIG. 7J. As an etching solution, $H_2SO_4$+$H_2O_2$ may be used.

11. Simultaneous Stacking (S11)

Figure 7K:
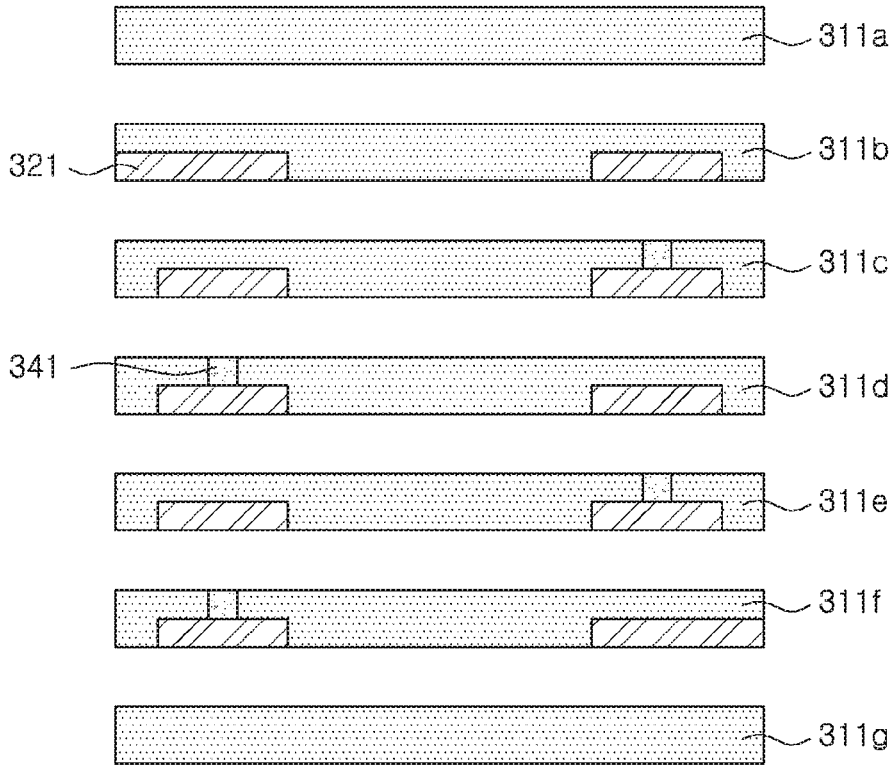

The masking film 370 may be removed, and each of the layers 311*a* to 311*g* may be stacked as shown in FIG. 7K. Since there is a need to form an Sn—Cu intermetallic compound for smooth connection of the via, vacuum pressing may be performed at 180° C. for 1 hour. The intermetallic compound may be formed by heating and at the same time, a dielectric resin may be completely cured. Since a tin-bismuth (Sn—Bi) alloy having a low melting point is used, unlike Inventive Example 2, a temperature at which the intermetallic compound is formed may be low, and thus, pressing may be performed at a low temperature.

Figure 7L:
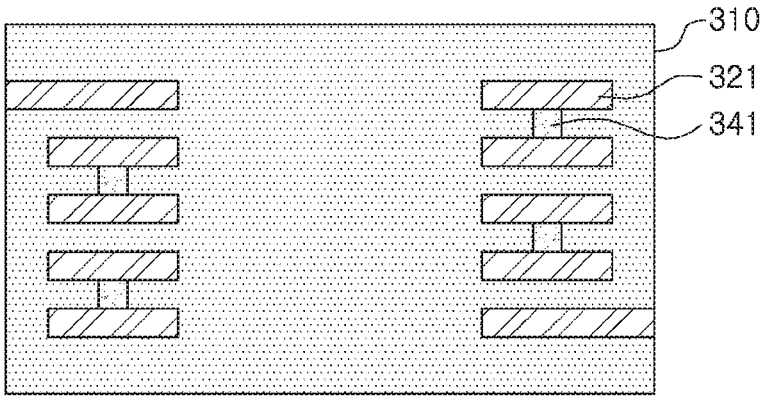

A body 310 in which the circuit pattern 321 and the bump 341 are formed, as illustrated in FIG. 7L, may be manufactured by simultaneously stacking each of the layers 311*a* to 311*g* individually formed as described above and compressing the simultaneously stacked layers.

12. Subsequently, the forming of external terminal electrodes may be similar to that in a manufacturing process of a general inductor (S12).

Inventive Example 4

1. Adhesion of Carrier Film and Copper Foil (S1)

Figure 8A:
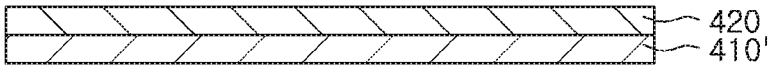
FIGS. 8A through 8M show sequential steps of a manufacturing process for an inductor according to Inventive Example 4.

A carrier film 410' and copper foil 420 may be adhered to each other, as shown in FIG. 8A, in the same manner as that disclosed in Inventive Example 3.

2. Lamination of DFR (PR) on Copper Foil (S2)

Figure 8B:
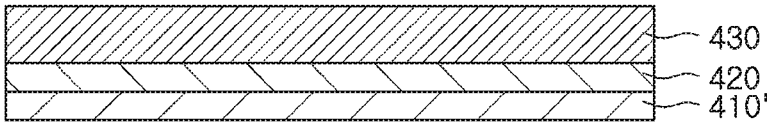

A dry film resist (DFR) (or photoresist (PR)) 430 may be laminated on the copper foil 420, as shown in FIG. 8B, in the same manner as in Inventive Example 3.

3. Exposure/Development (S3)

Figure 8C:
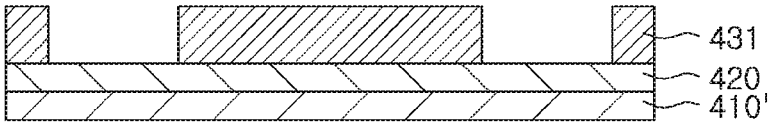

A dry film pattern 431 may be formed by exposure/development, as shown in FIG. 8C.

4. Electroplating (S4)

Figure 8D:
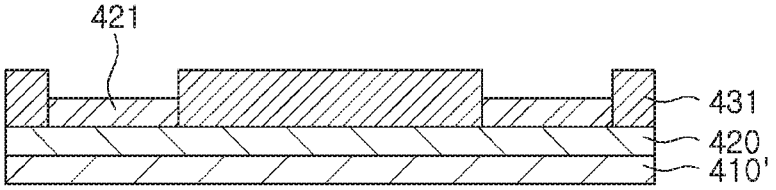

A circuit pattern 421 may be formed by electroplating (Cu plating), as shown in FIG. 8D. A plating thickness may be 8 μm.

5. Delamination of Dry Film Resist (DFR) (S5)

Figure 8E:
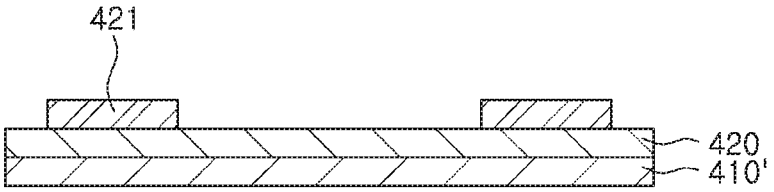

The circuit pattern 421 on each of the layers may be completed by removing the dry film resist (DFR), as shown in FIG. 8E.

6. Attachment of Dielectric Layer (S6)

Figure 8F:
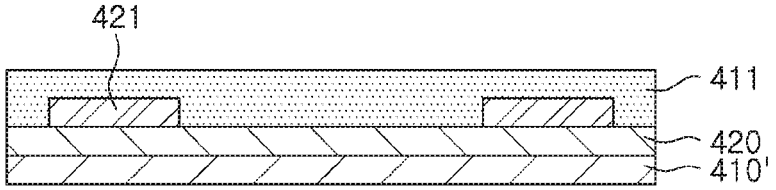

A dielectric film 411 may be laminated, as shown in FIG. 8F. The dielectric film 411 may be laminated to cover the circuit pattern 421 and the surface of the copper foil 420 having the circuit pattern 421 thereon. In the present Inventive Example, a height of the dielectric layer may be set to be an average 7 μm higher than an uppermost end of the circuit. As a dielectric material, a material capable of being UV cured and developed may be used.

7. Exposure/Development (S7)

Figure 8G:
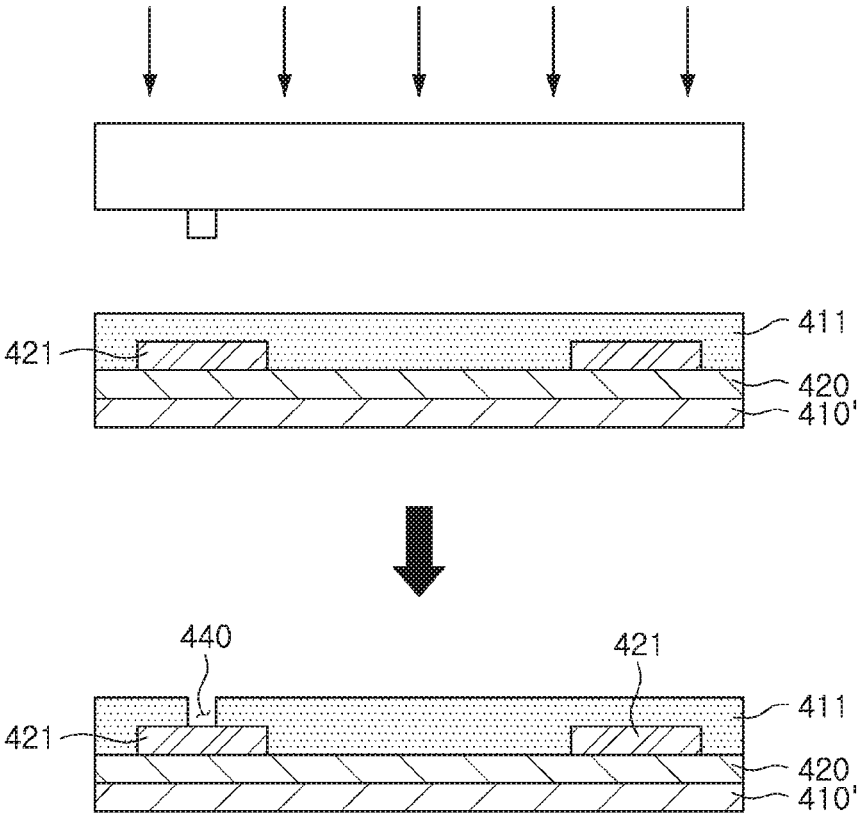

A via hole 440 may be formed by exposure and development after shielding a portion in which a via will be formed using a mask, as shown in FIG. 8G. A diameter of the via may be 30 μm.

8. Formation of Photo Via (Metal Mask Printing) (S8)

Figure 8H:
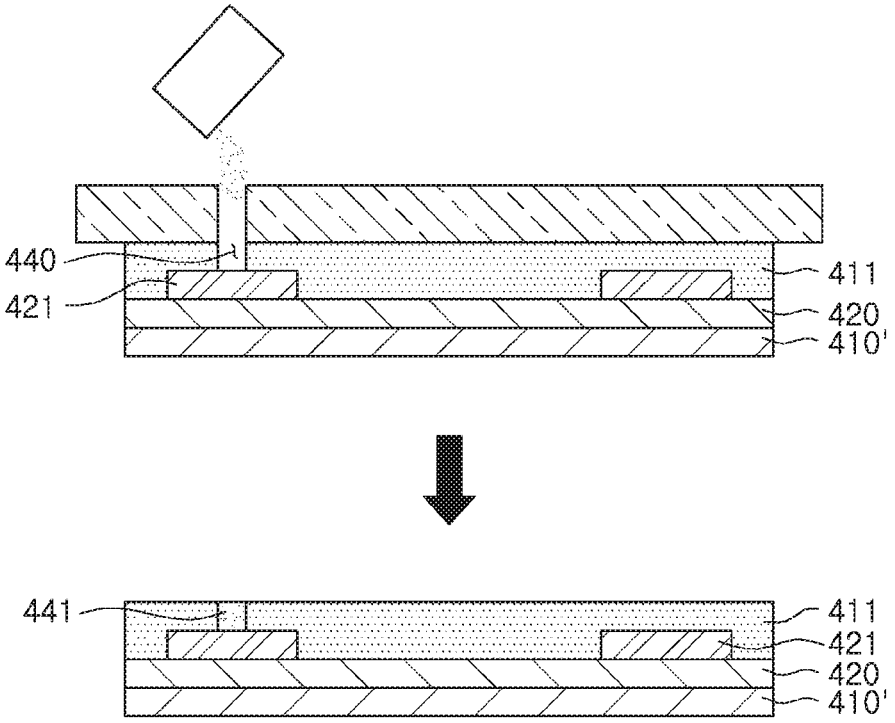

A via 441 may be filled using a metal mask by a printing method, as shown in FIG. 8H.

9. Attachment of Protective Masking Film (S9)

Figure 8I:
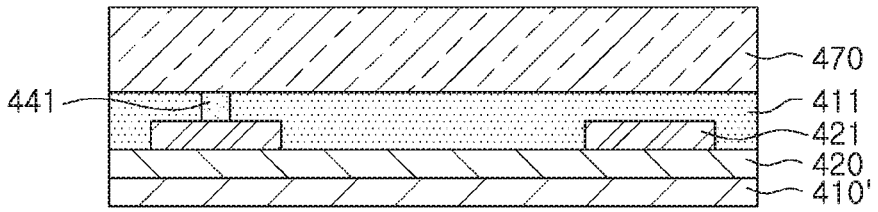

A protective masking film 470 may be attached as shown in FIG. 8I.

10. Removal of Carrier Film (S10)

Figure 8J:
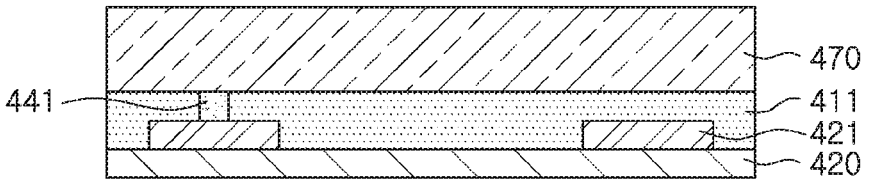

The carrier film 410' may be removed, as shown in FIG. 8J. The same film as that in Inventive Example 1 may be removed by the same method as in Inventive Example 1.

11. Etching of Copper Foil (S11)

Figure 8K:
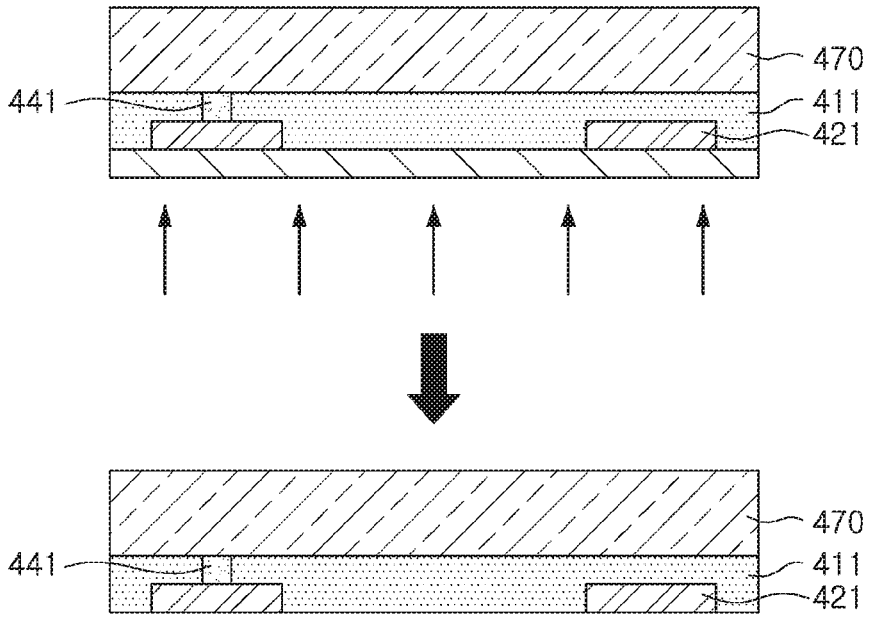

The copper foil 420 used as a seed layer for electroplating may be removed by etching, as shown in FIG. 8K. As an etching solution, $H_2SO_4$+$H_2O_2$ may be used.

12. Simultaneous Stacking (S12)

Figure 8L:
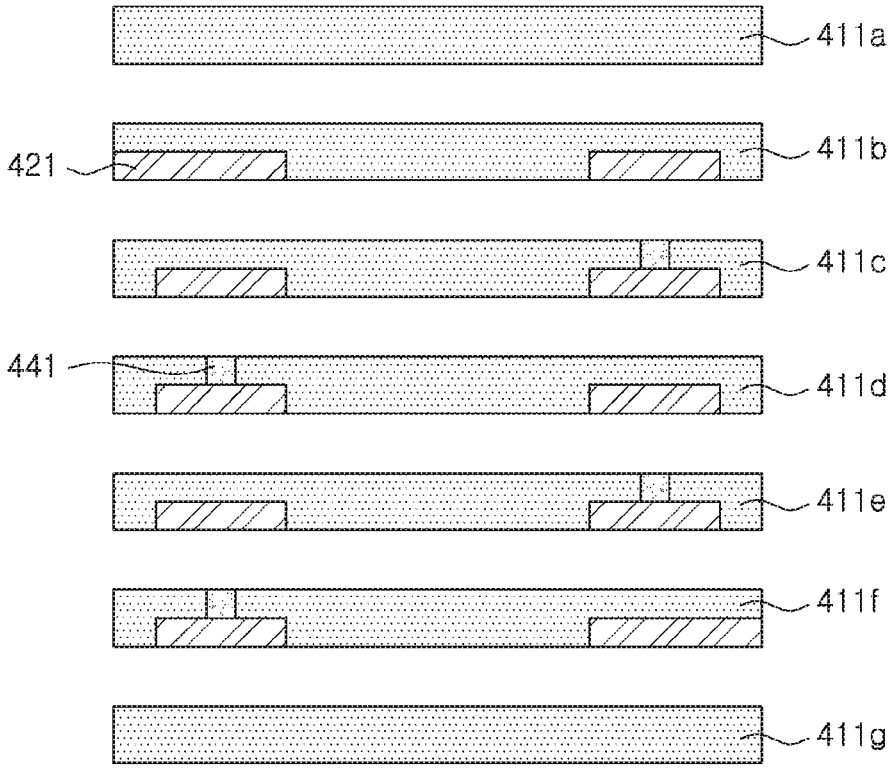

Simultaneous stacking may be performed, as shown in FIG. 8L, in the same manner as in Inventive Example 3.

The masking film 470 may be removed, and each of the layers 411*a* to 411*g* may be stacked.

Figure 8M:
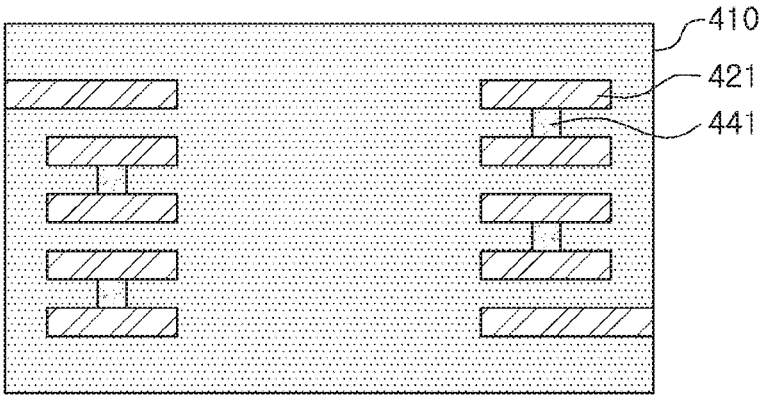

A body 410 in which the circuit pattern 421 and the via 441 are disposed as illustrated in FIG. 8M may be manufactured by simultaneously stacking each of the layers 411*a* to 411*g* individually formed as described above and compressing the simultaneously stacked layers.

13. Subsequently, the forming of external terminal electrodes may be similar to that in a manufacturing process of a general inductor (S13).

Inventive Example 5

1. Adhesion of Carrier Film and Copper Foil (S1)

Figure 9A:
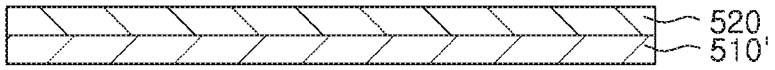
FIGS. 9A through 9M show sequential steps of a manufacturing process for an inductor according to Inventive Example 5.

A carrier film 510' and copper foil 520 may be adhered to each other as shown in FIG. 9A in the same manner as that disclosed in Inventive Example 3.

Although a modified semi-additive process (MSAP) is used as a circuit formation method in the present Inventive Example, the circuit formation method is necessarily not limited thereto. That is, a subtractive etching method may be used.

2. Lamination of DFR (PR) on Copper Foil (S2)

Figure 9B:
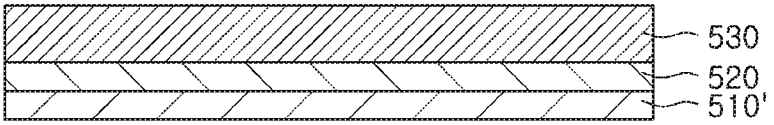

A dry film resist (DFR) (or photoresist (PR)) 530 may be laminated on the copper foil 520 as shown in FIG. 9B in the same manner as in Inventive Example 3.

3. Exposure/Development (S3)

Figure 9C:
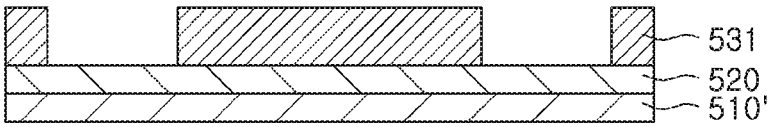

A dry film pattern 531 may be formed by exposure/development, as shown in FIG. 9C.

4. Electroplating (S4)

Figure 9D:
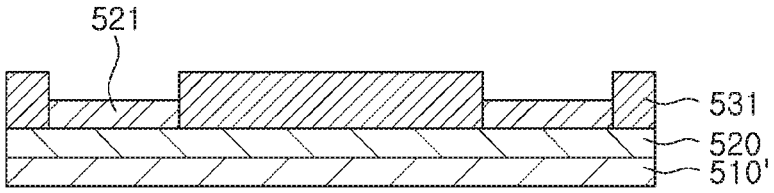

A circuit pattern 521 may be formed by electroplating (Cu plating), as shown in FIG. 9D. A plating thickness may be 8 μm.

5. Delamination of Dry Film Resist (DFR) (S5)

Figure 9E:
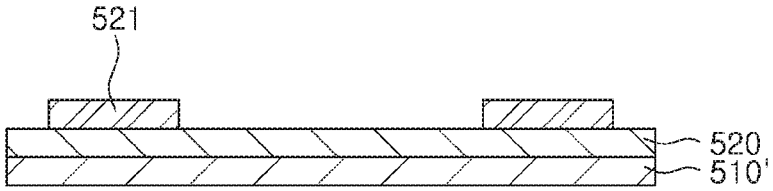

The circuit pattern 521 on each of the layers may be completed by removing the dry film resist (DFR), as shown in FIG. 9E.

6. Attachment of Dielectric Layer (S6)

Figure 9F:
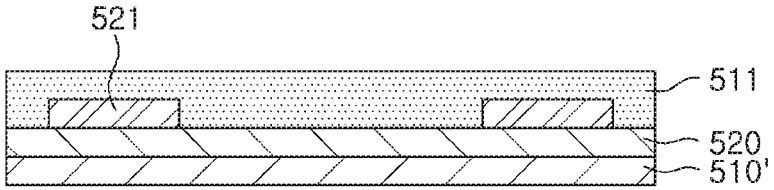

A film shaped dielectric layer may be laminated. In the present Inventive Example, a dielectric layer 511 may be laminated on the circuit pattern 521, as shown in FIG. 9F. As a dielectric material, a photosensitive dielectric material capable of being UV cured and developed may be used.

7. Exposure/Development (S7)

Figure 9G:
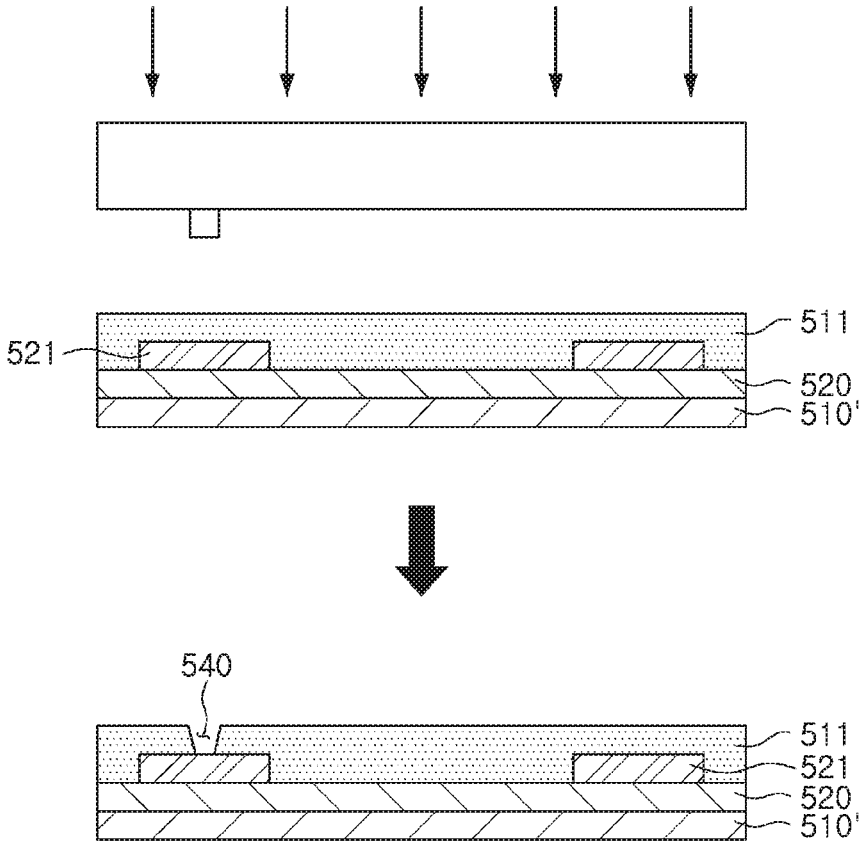

A via hole 540 may be formed by performing exposure and development on the photosensitive dielectric material after shielding a portion in which a via will be formed using a mask, as shown in FIG. 9G. In the present Inventive Example, a diameter of the via 541 may be 30 μm, exposure and development may be performed so that the via 541 has a diameter of about 30 μm in the vicinity of a surface of the dielectric layer 511 in an exposure direction, and an entire cross-sectional shape of the via 541 may be tapered.

8. Cu Fill Plating on Interior of Developed Via (S8)

Figure 9H:
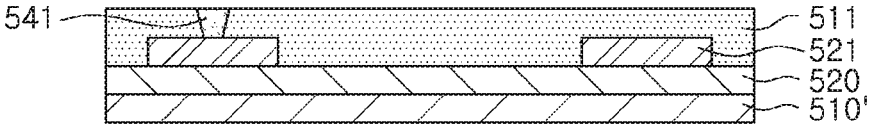

Cu Fill Plating may be performed on an interior of the developed Via 541, as shown in FIG. 9H. After plating, in order to planarize an upper surface of the plated via, lapping, brush-polishing, or the like, may be performed thereon.

9. Tin (Sn) Plating on Cu Fill Plating (S9)

Figure 9I:
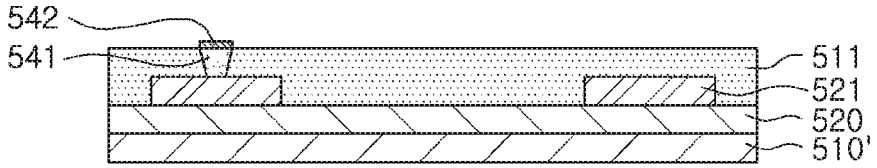

A tin (Sn) plating layer 542 may be formed on an upper surface of the Cu Fill plating formed on the via hole, as shown in FIG. 9I. In this case, a suitable thickness of the tin (Sn) plating layer 542 may be 1 to 10 μm. In the present Inventive Example, the tin (Sn) plating layer may be formed to have a thickness of 3 μm.

10. Attachment of Protective Masking Film (S10)

Figure 9J:
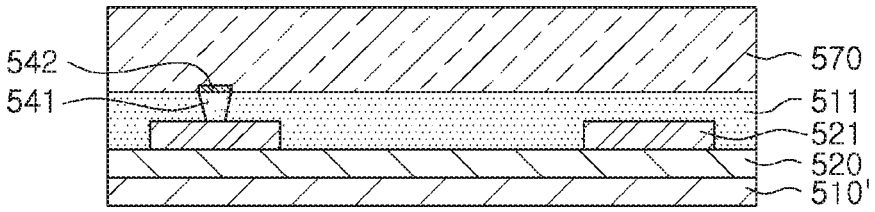

A protective masking film 570 may be attached, as shown in FIG. 9J.

11. Removal of Carrier Film (S11)

Figure 9K:
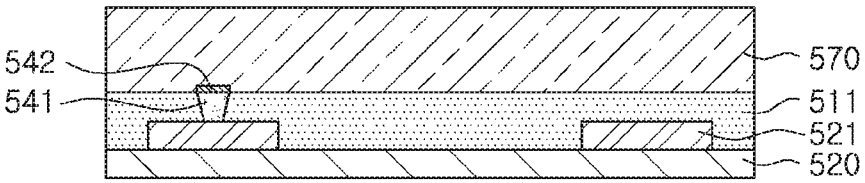

The carrier film 510' may be removed as shown in FIG. 9K. The same film as that in Inventive Example 1 may be removed by the same method as in Inventive Example 1.

12. Etching of Copper Foil (S12)

Figure 9L:
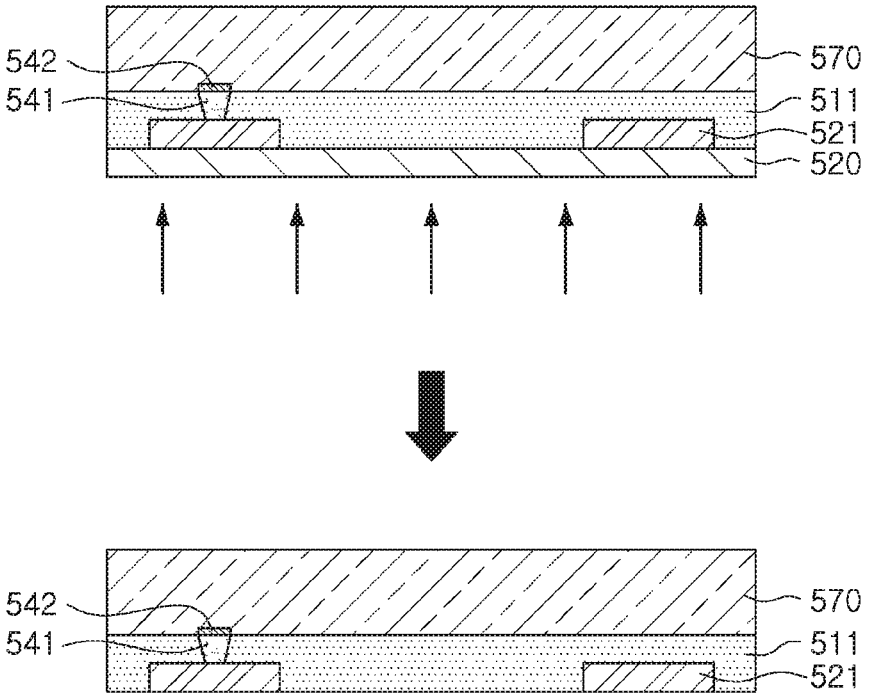

The copper foil 520 used as a seed layer for electroplating may be removed by etching, as shown in FIG. 9L. As an etching solution, $H_2SO_4$+$H_2O_2$ may be used.

13. Simultaneous Stacking (S13)

Figure 9M:
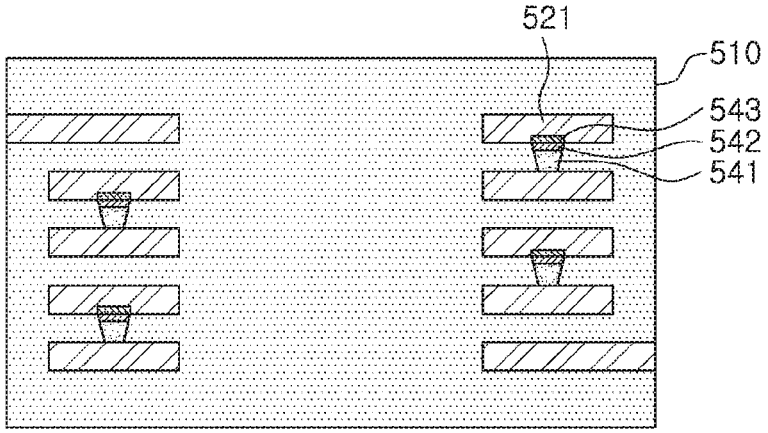

After the masking film 570 is removed, each of the layers may be stacked, as shown in FIG. 9M. Since there is a need to form an Sn—Cu intermetallic compound for smooth connection of the via, vacuum pressing may be performed at 200° C. for 1 hour. The intermetallic compound may be formed by heating and at the same time, a dielectric resin may be completely cured. Since the tin (Sn) plating is performed on the copper fill plating, the intermetallic compound 543 may be formed at an Sn—Cu interface. In this case, examples of the formed intermetallic compound may include $Cu_6Sn_5$, $Cu_3Sn$, and the like.

A body 510 in which the circuit pattern 521, the via 541, the tin (Sn) plating layer 542, and the intermetallic compound 543 formed on the Sn—Cu interface are disposed as illustrated in FIG. 9M may be manufactured by simultaneously stacking each of the layers individually formed as described above and compressing the simultaneously stacked layers.

14. Subsequently, the forming of external terminal electrodes may be similar to that in a manufacturing process of a general inductor (S14).

Inventive Example 6

1. Adhesion of Carrier Film and Copper Foil (S1)

Figure 10A:
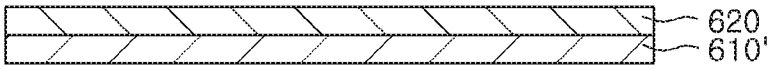
FIGS. 10A through 10M show sequential steps of a manufacturing process for an inductor according to Inventive Example 6.

A carrier film 610' and copper foil 620 may be adhered to each other, as shown in FIG. 10A, in the same manner as that disclosed in Inventive Example 5.

2. Lamination of DFR (PR) on Copper Foil (S2)

Figure 10B:
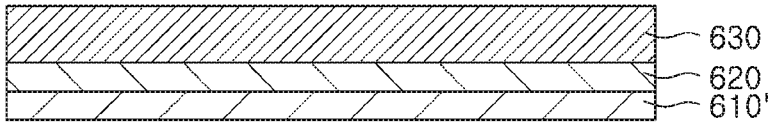

A dry film resist (DFR) (or photoresist (PR)) 630 may be laminated on the copper foil 620, as shown in FIG. 10B, in the same manner as that disclosed in Inventive Example 5.

3. Exposure/Development (S3)

Figure 10C:
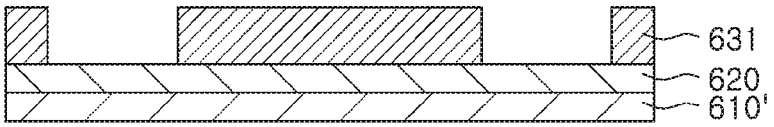

A dry film pattern 631 may be formed by exposure/development, as shown in FIG. 10C.

4. Electroplating (S4)

Figure 10D:
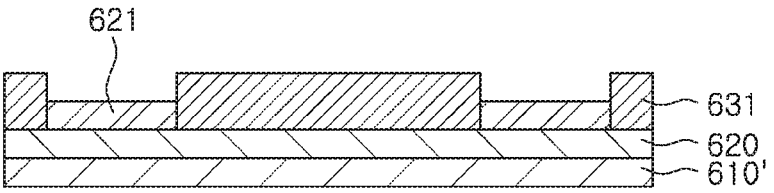

A circuit pattern 621 may be formed by electroplating (Cu plating), as shown in FIG. 10D. A plating thickness may be 8 μm.

5. Delamination of Dry Film Resist (DFR) (S5)

Figure 10E:
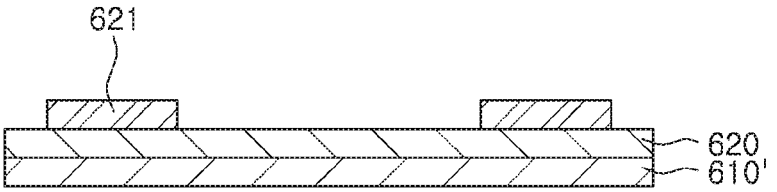

The circuit pattern 621 on each of the layers may be completed by removing the dry film resist (DFR), as shown in FIG. 10E.

6. Attachment of Dielectric Layer (S6)

Figure 10F:
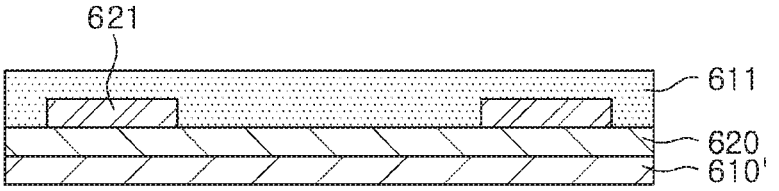

A dielectric layer 611 may be laminated on the circuit pattern 621, as shown in FIG. 10F. As a dielectric material, a material capable of being in a semi-cured state by heat curing may be used. A dielectric film may be formed of a thermosetting resin material having a semi-cured state. Examples of this material may include prepreg, a bismaleimide-triazine (BT) resin, and the like. In the present Inventive Example, the bismaleimide-triazine (BT) resin may be used.

7. Laser Drilling (S7)

Figure 10G:
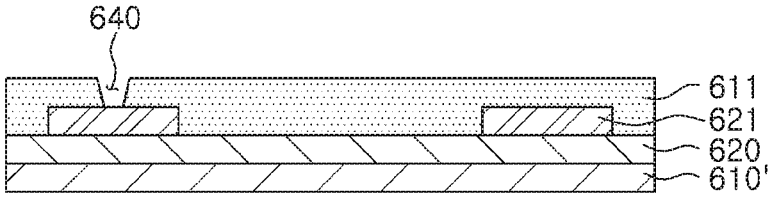

A via hole 640 may be processed using a laser, as shown in FIG. 10G. In the present Inventive Example, a diameter of a via may be 30 μm. In a laser drilling method, any of a $CO_2$ laser and solid laser may be used, and a diameter of the via hole may be in a range of 10 to 200 μm. In the present Inventive Example, the via hole 640 having a diameter of 30 μm may be formed using the $CO_2$ laser.

8. Cu Fill Plating on Interior of Via (S8)

Figure 10H:
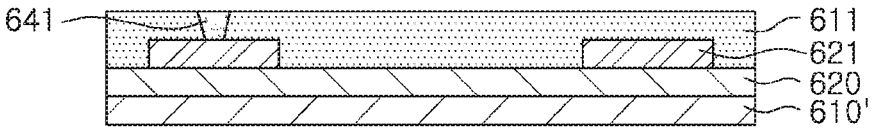

Cu Fill Plating may be performed on an interior of a via 641, as shown in FIG. 10H. After plating, in order to planarize an upper surface of the plated via, lapping, brush-polishing, or the like, may be performed thereon.

At this time, a via conductor may be formed only by tin (Sn) plating corresponding to a subsequent process without performing the Cu fill plating on the interior of the via.

9. Tin (Sn) Plating on Cu Fill Plating (S9)

Figure 10I:
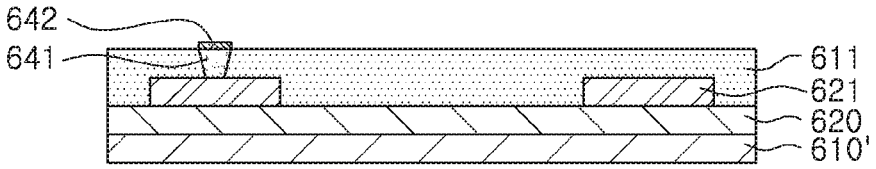

A tin (Sn) plating layer 642 may be formed on an upper surface of the Cu Fill plating formed in the via hole, as shown in FIG. 10I. In this case, a suitable thickness of the tin (Sn) plating layer 642 may be 1 to 10 μm. In the present Inventive Example, the tin (Sn) plating layer 642 may be formed to have a protrusion height of 3 μm.

10. Attachment of Protective Masking Film (S10)

Figure 10J:
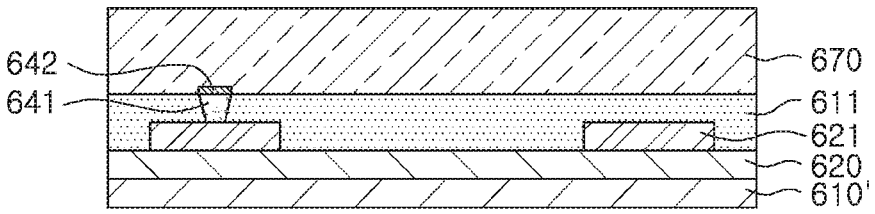

A protective masking film 670 may be attached, as shown in FIG. 10J. In order to protect the via 641, the masking film 670 may be attached.

11. Removal of Carrier Film (S11)

Figure 10K:
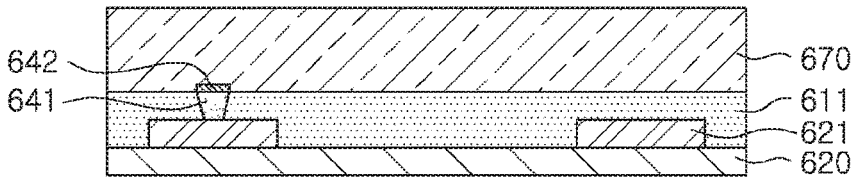

The carrier film 610' may be removed, as shown in FIG. 10K. As the carrier film, a thermally foamable film may be used, and the carrier film may be removed by heating at 100° C.

12. Etching of Copper Foil (S12)

Figure 10L:
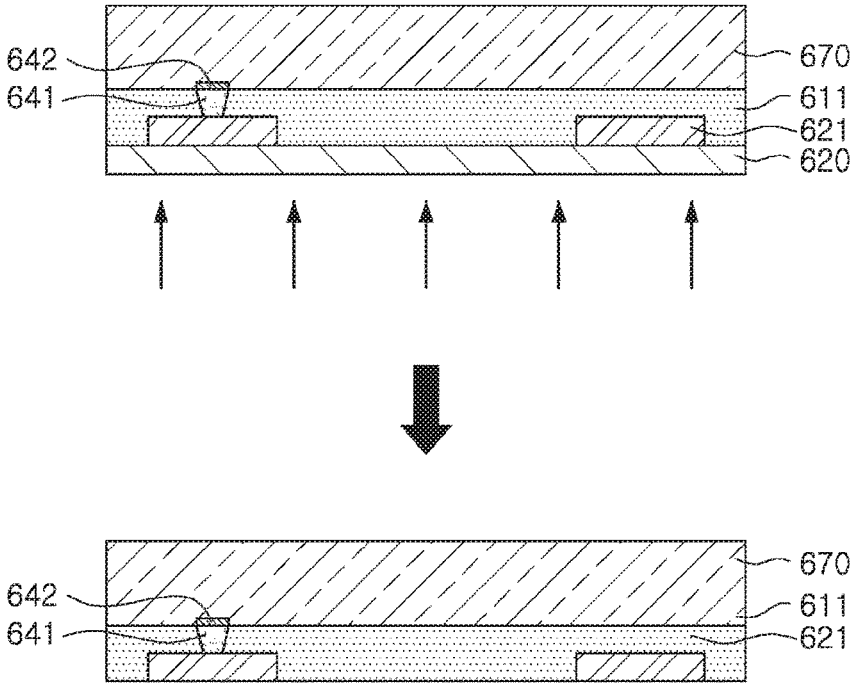

The copper foil 620 used as a seed layer for electroplating may be removed by etching, as shown in FIG. 10L. As an etching solution, $H_2SO_4$+$H_2O_2$ may be used.

13. Simultaneous Stacking (S13)

After the masking film 670 is removed, each of the layers may be stacked. Since there is a need to form an Sn—Cu intermetallic compound for smooth connection of the via 641, vacuum pressing may be performed at 200° C. for 1 hour. The intermetallic compound may be formed by heating and at the same time, a dielectric resin may be completely cured. Since the tin (Sn) plating is performed on the copper fill plating, the intermetallic compound 643 may be formed at an Sn—Cu interface. In this case, examples of the formed intermetallic compound may include $Cu_6Sn_5$, $Cu_3Sn$, and the like.

Similarly to Inventive Examples 2 and 5, for stable electrical connection of the plated tin layer, a circuit layer, and the via 641, a heat treatment may be separately performed.

Heat treatment (maximum heat treatment temperature: 260° C.) may be performed for 1 second.

The intermetallic compound 643 between tin and a circuit conductor may be sufficiently formed by a heat treatment as described above.

Figure 10M:
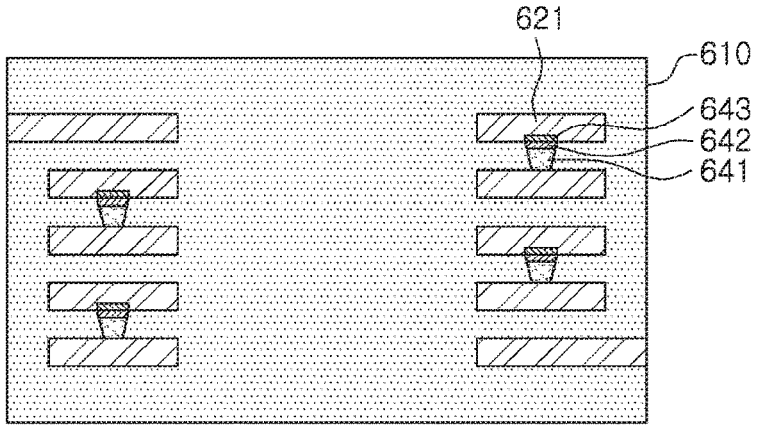

A body 610 in which the circuit pattern 621, the via 641, the tin (Sn) plating layer 642, and the intermetallic compound 643 formed on the Sn—Cu interface are disposed as illustrated in FIG. 10M may be manufactured by simultaneously stacking each of the layers individually formed as described above and compressing the simultaneously stacked layers.

14. Subsequently, the forming of external terminal electrodes may be similar to that in a manufacturing process of a general inductor (S14).

Hereinafter, Q values and inductances of the inductor manufactured in Inventive Example 1 and an inductor manufactured by a general method were simulated and compared with each other.

In the inductor manufactured in accordance with Inventive Example 1, a copper (Cu) plated electrode was used, and the inductor of Comparative Example was manufactured with a sintered silver (Ag) electrode using a general method.

TABLE 1

| | Comparative Example | Inventive Example 1 |
|---|---|---|
| Specific Resistance (μΩ · cm) of Conductor | 2.1 (Sintered Ag) | 1.7 (Copper Foil/ Copper Plating) |
| Specific Resistance (μΩ · cm) of Via | 2.1 (Sintered Ag) | 80 (Sn-based Paste) |
| Line Width/Thickness (μm) | 15/8 | 15/8 |
| Insulation Distance (μm) | 7 | 7 |
| Q Value (@2.4 GHz) | 29.28 | 35.60 |
| Inductance (nH) | 15.06 | 14.09 |

Referring to Table 1, it may be appreciated that in Inventive Example 1 in which the inductor was manufactured using the copper (Cu) plated electrode, the Q value was significantly improved as compared to the Comparative Example in which the inductor was manufactured using the sintered silver (Ag) electrode by the general method.

In Inventive Example 2, since the via conductor was also formed of the copper (Cu) plated electrode, an effect of increasing the Q value may be more excellent.

As set forth above, according to the exemplary embodiments presented herein, the Q value may be increased by using a copper (Cu) plated electrode material instead of a sintered silver (Ag) electrode material.

The copper plated electrode is disadvantageous as compared to the sintered silver (Ag) electrode material in view of the specific resistance of the pure material. However, since an increase in resistance by a grain boundary is small in a plated electrode as compared to a sintered electrode due to characteristics of the plated electrode, the copper plated electrode is more advantageous than the sintered silver electrode.

In general, specific resistance of the copper plated electrode is about 1.7 to 1.8μΩcm, but specific resistance of a sintered silver (Ag) electrode used in a multilayer ceramic method is about 2.0 to 2.2μΩcm.

In addition, according to the exemplary embodiment presented in the present disclosure, since the circuit pattern is formed by copper plating/copper foil etching, the thickness of the wire may be freely adjusted.

As the method of forming the circuit coil pattern, there are the tenting method using Cu foil etching, the semi-additive process (SAP) using copper plating, the modified semi-additive process (MSAP), and the like. In the exemplary embodiment, any method may be used without particular limitation.

Since a circuit coil pattern was formed by a screen printing method in a ceramic inductor according to the related art, the circuit coil pattern of the prior-art is subject to a limitation on increasing a thickness of a wire, and since the thickness has been decreased during the sintering, it has been difficult to increase the thickness of the wire.

In contrast, in the method provided herein of forming the circuit coil pattern according to the exemplary embodiment, since it is easy to adjust a plating thickness and a thickness of the copper foil, resistance may be decreased by freely increasing the thickness of a copper (Cu) circuit coil and thus the Q value may be increased.

In addition, according to the exemplary embodiment, since the circuit pattern is formed by copper foil etching, the thickness of the wire may be freely adjusted. Resistance may therefore be decreased by freely increasing the thickness of the wire, such that the Q value may be increased.

Further, according to the exemplary embodiment, since a material containing the organic material such as the polymer, or the like, is used as the main ingredient in the dielectric material, low permittivity may be implemented.

Additionally, permittivity of a glass ceramic material as is commonly used in ceramic inductors according to the related art is about 5 to 10, and permittivity of a ferrite material is about 15. However, permittivity of the dielectric material containing the organic material as the main ingredient is generally 5 or less.

Therefore, an influence of a self resonance phenomenon having a negative influence on the Q factor may be decreased.

That is, since a self resonant frequency (SRF) is increased as compared to the ceramic inductor according to the related art due to low permittivity, the influence of self-resonance on the inductor may also be decreased in a frequency band of several GHz, and thus a stable Q factor may be implemented.

Further, a step portion generated at the time of stacking may be effectively suppressed by using an organic insulating material of which a content of an inorganic material is low and flowability is good as compared to a ceramic sheet.

As a method of solving a step portion problem, the present disclosure suggests two methods. First, a method is provided for forming layers so that there is substantially no step portion by using flowability of the organic insulating material at the time of forming each of the layers. Second, a method is provided for decreasing the step portion by using flowability of the organic insulating material at the time of simultaneously stacking the layers.

In both of the methods, the step portion problem may be solved by using flowability of the organic insulating material in the semi-cured state.

The semi-cured state may be implemented using the thermosetting resin material having the B-stage such as prepreg, the bismaleimide-triazine (BT) resin, and the like, or using the resin material simultaneously having UV curing mechanism and/or thermal curing mechanism.

While exemplary embodiments have been shown and described above, it will be apparent to those skilled in the art that modifications and variations could be made without departing from the scope of the present invention as defined by the appended claims.

What is claimed is:

1. An inductor comprising:

a body including an organic material and a coil part disposed within the body; and external electrodes disposed on outer surfaces of the body and connected to the coil part, wherein the coil part includes a conductive pattern and first and second conductive vias, upper and lower surfaces of the conductive pattern each include a first portion directly contacting the organic material and a second portion directly contacting an adhesive layer disposed directly between the second portion of the upper or lower surface of the conductive pattern and a respective one of the first and second conductive vias, and the adhesive layer is formed of a material different from materials of the conductive pattern and the first and second conductive vias, the conductive pattern and conductive vias contain copper (Cu), and the adhesive layer contains tin (Sn), and the adhesive layer is disposed between at least one of the first and second conductive vias and the conductive pattern and between at least one of the first and second conductive vias and the body.

2. The inductor of claim 1, wherein the organic material in the body is a photosensitive organic material.

3. The inductor of claim 2, wherein the organic material in the body is a photosensitive organic material that is both UV curable and thermally curable.

4. The inductor of claim 1, wherein the organic material in the body is a thermally curable organic material.

5. The inductor of claim 1, wherein the body further contains an inorganic material, and a content of the inorganic material in the body is lower than a content of the organic material in the body.

6. The inductor of claim 1, wherein the body includes a plurality of organic layers that are stacked.

7. The inductor of claim 6, wherein the plurality of organic layers come into direct contact with each other.

8. The inductor of claim 1, wherein the adhesive layer is formed of a material having a melting point lower than melting points of the conductive pattern and the conductive vias.

9. The inductor of claim 1, wherein a compound containing tin (Sn) and copper (Cu) is formed between the conductive pattern and the adhesive layer.

10. The inductor of claim 1, wherein a compound containing tin (Sn) and copper (Cu) is formed between the conductive vias and the adhesive layer.

11. The inductor of claim 1, wherein the conductive vias are formed of a paste including a mixture of an organic material and the copper (Cu).

12. An inductor comprising:

a body; and a coil part disposed within the body and including:

a conductive pattern; and a plurality of vias interconnecting portions of the conductive pattern, wherein the vias contain a mixture of an organic material and Sn, and wherein upper and lower surfaces of the conductive pattern each include a first portion directly contacting the body and a second portion directly contacting an adhesive layer disposed directly between the second portion of the upper or lower surface of the conductive pattern and a respective via of the plurality of conductive vias, the adhesive layer comprises an intermetallic compound disposed at contacts between the vias and conductive pattern and between the vias and the body, and a material of the adhesive layer is different from the conductive pattern and the conductive via.

13. The inductor of claim 12, wherein the body contains a photosensitive organic material.

14. The inductor of claim 13, wherein the organic material of the body includes both a UV curing mechanism and a thermal curing mechanism.

15. The inductor of claim 13, wherein the body contains a mixture of the photosensitive organic material and an inorganic material.

16. The inductor of claim 12, wherein the vias and conductive pattern include different metal materials.

17. The inductor of claim 16, wherein the vias are formed of a mixture of the organic material and Sn or an Sn-based intermetallic compound (IMC), and the conductive pattern is formed of Cu.

18. The inductor of claim 12, wherein the vias contain the organic material in a volume ratio of 20 to 80%.

19. The inductor of claim 12, further comprising:

two external electrodes disposed on outer surfaces of the body and electrically connected to respective ends of the coil part, wherein each external electrode extends on at most two outer surfaces of the body.

20. The inductor of claim 19, wherein each external electrode has an 'L' shape extending on two adjacent outer surfaces of the body.

* * * * *